US008820305B2

(12) United States Patent
Victor et al.

(10) Patent No.: US 8,820,305 B2
(45) Date of Patent: Sep. 2, 2014

(54) TOY PROJECTILE LAUNCHER APPARATUS

(75) Inventors: Robert James Victor, Sunnyside, NY (US); Meredith Brooks, Attleboro, MA (US)

(73) Assignee: Hasbro, Inc., Pawtucket, RI (US)

( * ) Notice: Subject to any disclaimer, the term of this patent is extended or adjusted under 35 U.S.C. 154(b) by 76 days.

(21) Appl. No.: 13/526,712

(22) Filed: Jun. 19, 2012

(65) Prior Publication Data

US 2013/0074818 A1 Mar. 28, 2013

Related U.S. Application Data

(63) Continuation-in-part of application No. 13/246,172, filed on Sep. 27, 2011, now Pat. No. 8,567,377.

(60) Provisional application No. 61/388,383, filed on Sep. 30, 2010, provisional application No. 61/388,370, filed on Sep. 30, 2010.

(51) Int. Cl.
*F41B 7/08* (2006.01)
*F41B 7/00* (2006.01)

(52) U.S. Cl.
CPC .. *F41B 7/003* (2013.01); *F41B 7/08* (2013.01)
USPC ..... 124/27

(58) Field of Classification Search
USPC ..... 124/16, 26, 27, 81
See application file for complete search history.

(56) References Cited

U.S. PATENT DOCUMENTS

| | | | | |
|---|---|---|---|---|
| 368,307 | A | 8/1887 | Rhodes | |
| 961,511 | A | 6/1910 | Marble | |
| 1,294,917 | A | 2/1919 | Koontz | |
| 1,353,663 | A | 9/1920 | Napier | |
| 1,374,757 | A | 4/1921 | Napier | |
| 3,430,620 | A | 3/1969 | Davis | |
| 3,635,204 | A | 1/1972 | Plumb, Jr. | |
| 3,640,263 | A * | 2/1972 | Rhodes | 124/75 |
| 3,662,729 | A * | 5/1972 | Henderson | 124/73 |
| 3,949,731 | A | 4/1976 | Caso | |
| 3,968,783 | A | 7/1976 | Pfotenhauer | |
| 4,016,854 | A | 4/1977 | Lehman | |
| 4,030,472 | A | 6/1977 | Watkins | |
| 4,059,089 | A | 11/1977 | Lehman | |
| 4,067,308 | A | 1/1978 | Andersen et al. | |
| 4,170,215 | A | 10/1979 | Kettlestrings | |
| 4,248,202 | A | 2/1981 | Jaworski et al. | |
| 4,270,293 | A | 6/1981 | Plumer et al. | |
| 4,335,701 | A | 6/1982 | Bozich | |
| 4,501,257 | A * | 2/1985 | Kholin | 124/81 |
| 4,659,320 | A | 4/1987 | Rich et al. | |
| 5,224,701 | A | 7/1993 | Sciarriallo et al. | |

(Continued)

*Primary Examiner* — John Ricci
(74) *Attorney, Agent, or Firm* — Perry Hoffman

(57) ABSTRACT

Several variations of a toy projectile launcher apparatus for discharging EVA balls. The apparatus includes a housing, a barrel portion, a grip portion, a trigger, a ram movable in the housing, a carriage also movable in the housing, a negator spring, handles for cocking the apparatus, and a lever pivotally mounted to a shaft in the housing just behind a ball to be discharged. In operation, a user pulls a handle rearward to move the ram and carriage and extend the spring. Pulling the trigger disengages the ram to impact the lever causing the lever to slap the ball to cause discharge of the ball. The lever and the shaft may be moved from side to side to cause the ball to be discharged straight ahead or curved to the left or right.

20 Claims, 21 Drawing Sheets

(56) References Cited

U.S. PATENT DOCUMENTS

| | | | |
|---|---|---|---|
| 5,355,866 | A | 10/1994 | Hunter |
| 5,471,967 | A | 12/1995 | Matsuzaki et al. |
| 5,529,050 | A | 6/1996 | D'Andrade |
| 5,611,322 | A | 3/1997 | Matsuzaki et al. |
| 5,782,228 | A | 7/1998 | Wu |
| 5,970,970 | A | 10/1999 | Vanek et al. |
| 5,996,564 | A | 12/1999 | Kotowski |
| 6,224,457 | B1 | 5/2001 | Wu |
| 6,598,329 | B1 | 7/2003 | Alexander |
| 6,733,356 | B2 | 5/2004 | Lee |
| 7,163,009 | B2 | 1/2007 | Brown |
| 7,287,526 | B1 | 10/2007 | Bligh et al. |
| 7,418,797 | B1 | 9/2008 | Crose |
| 7,437,847 | B1 | 10/2008 | Mabry |
| 7,552,557 | B1 | 6/2009 | Mabry |
| 7,673,624 | B2 | 3/2010 | Rosella, Jr. |
| 2006/0242880 | A1 | 11/2006 | Griffin |
| 2007/0069064 | A1 | 3/2007 | Mott |

* cited by examiner

TOY PROJECTILE LAUNCHER APPARATUS

PRIORITY CROSS-REFERENCE TO RELATED APPLICATIONS

This application is a continuation-in-part and claims priority pursuant to 35 U.S.C. 119(e) from U.S. Provisional Patent Applications, Nos. 61/388,370 and 61/388,383, both filed on Sep. 30, 2010, and U.S. Patent Application Publication. No. U.S. 2012/0080018 A1, patent application Ser. No. 13/246,172, filed on Sep. 27, 2011, which are all expressly incorporated herein by reference.

FIELD OF THE INVENTION

The present invention relates generally to a projectile launcher apparatus, and, more particularly, to a toy projectile launcher apparatus that discharges a spherical-shaped projectile with good flight characteristics, distance and the ability to curve the projectile to the left or the right.

BACKGROUND OF THE INVENTION

Toys and other devices that discharge projectiles have been designed in the past with various housing and internal elements. These devices are often difficult to use or even dangerous for children, or are too expensive, complicated or insufficiently robust.

Examples of prior patents include U.S. Pat. No. 4,016,854, for a "Spring Type Bottle Cap Pistol" issued in 1977 to Lehman that purports to disclose a pistol to propel and spin a bottle cap by attaching a compression spring to a plunger in a lower chamber, attaching a hammer to the plunger, where the hammer extends through a slot in a upper chamber where the bottle cap is loaded. The plunger is pulled back by a user to compress the spring and the plunger is restrained by a trigger assembly. The hammer is located off-center from the bottle cap so that when a trigger is pulled, the plunger is released and under the biasing force of the spring accelerates the hammer and bottle cap along the upper chamber to discharge the bottle cap while also inducing a spin in the cap. A restraining pin extends through a slot to abut an interior surface wall of the bottle cap to prevent the bottle cap from moving until the trigger is depressed at which time the pin moves out of the way. Another patent issued to Lehman later in 1977, U.S. Pat. No. 4,059,089 for a "Flying Saucer Launching Pistol" purports to disclose a pistol very similar to that disclosed in his earlier patent but with a pair of ramps in the firing chamber tapered so as to center different diameter discs when each is loaded.

U.S. Pat. No. 4,170,215 for a "Disk Toy And Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs the spring propels the disk away from the launcher. In 1999, a patent issued to Vanek and others for a "Ring Airfoil Launcher" U.S. Pat. No. 5,970,970, and purports to disclose a rifle for safely launching ring airfoils. The rifle includes a coil spring that is extended by a handle to cock the rifle, and a trigger to hold and release the stretched spring. A similar product for launching ring airfoils, known as the Vortex Tornado, also includes a coil spring that is extended by a rearward pulled handle but the product does not have a trigger. When the handle is retracted, pulled rearward, to a predetermined location, the airfoil is released.

Another earlier U.S. patent issued to Brown and others in 2007, U.S. Pat. No. 7,163,009, for a "Toy Gun For Launching A Foam Projectile." The '009 patent purports to disclose a toy gun having a paddle wheel with four flexible paddles that are rotated by a crank manipulated by a gun user. Foam balls are located in the path of the paddles and each rotating paddle imparts discharge energy to a ball. Also placed in the path of the paddles is a post that interferes with rotation of the paddles, causing each paddle to be stressed by being deflected or bent rearward until the paddle slides away from the post. The post-added stress causes each paddle to act like a spring to slap at a ball and impart discharge energy. A U.S. Application Publication also occurred in 2007, for a "Barrel Attachment For A Gas Gun," Publication No. 2007/0069064. The application listed Mott as inventor and purported to disclose the use of a spin attachment to the barrel of a gas gun. Within the spin attachment is a movable deflection wall made of a flexible material. A slider moveable by a user causes the deflection wall to flex inward and engage a fired projectile as it exits the barrel causing the projectile to spin. The passing engagement between the deflection wall and the projectile allows the user to curve the trajectory of the projectile to hit targets behind an obstruction.

These patents and devices are of some interest, however, they do not disclose or illustrate a simple, inexpensive, fun to use and robust toy item.

SUMMARY OF THE INVENTION

In accordance with the present invention, an advantageous method and various apparatus are provided in the form of a toy projectile launcher apparatus that discharges a spherical-shaped projectile. The toy launcher is easily operated, even by young children, and requires a ball to be loaded, a handle to be moved rearward to extend a constant force launch spring, and a lever to be impacted to cause the ball to be discharged. The energy from the launch spring is transferred through a carriage and a ram to the lever that in turn slaps the ball to cause ejection of the ball with a backspin. The launcher apparatus also has the advantages of being relatively simple, fun to use, safe, relatively inexpensive, compact and yet, structurally robust.

Briefly summarized, the invention relates to a projectile launcher apparatus including a housing having a longitudinal axis, structure connected to the housing for providing energy to discharge a projectile mounted to the housing, structure connected to the housing for imparting discharge energy to the projectile, the structure for imparting discharge energy being movable in a direction generally perpendicular to the longitudinal axis of the housing for curving a projectile upon discharge, and structure connected to the energy imparting structure for moving the energy imparting structure.

The invention of the parent application also relates to a method for making a toy launcher apparatus capable of discharging spherical projectiles, the steps of the method including providing a housing having a longitudinal axis, connecting structure to the housing for providing energy to discharge a projectile, connecting structure to the housing for imparting energy to the projectile, and connecting structure to the energy imparting structure for moving the energy imparting structure in a direction generally perpendicular to the longitudinal axis of the housing.

BRIEF DESCRIPTION OF THE DRAWINGS

For the purpose of facilitating an understanding of the invention, the accompanying drawings and detailed description illustrate a preferred embodiment thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
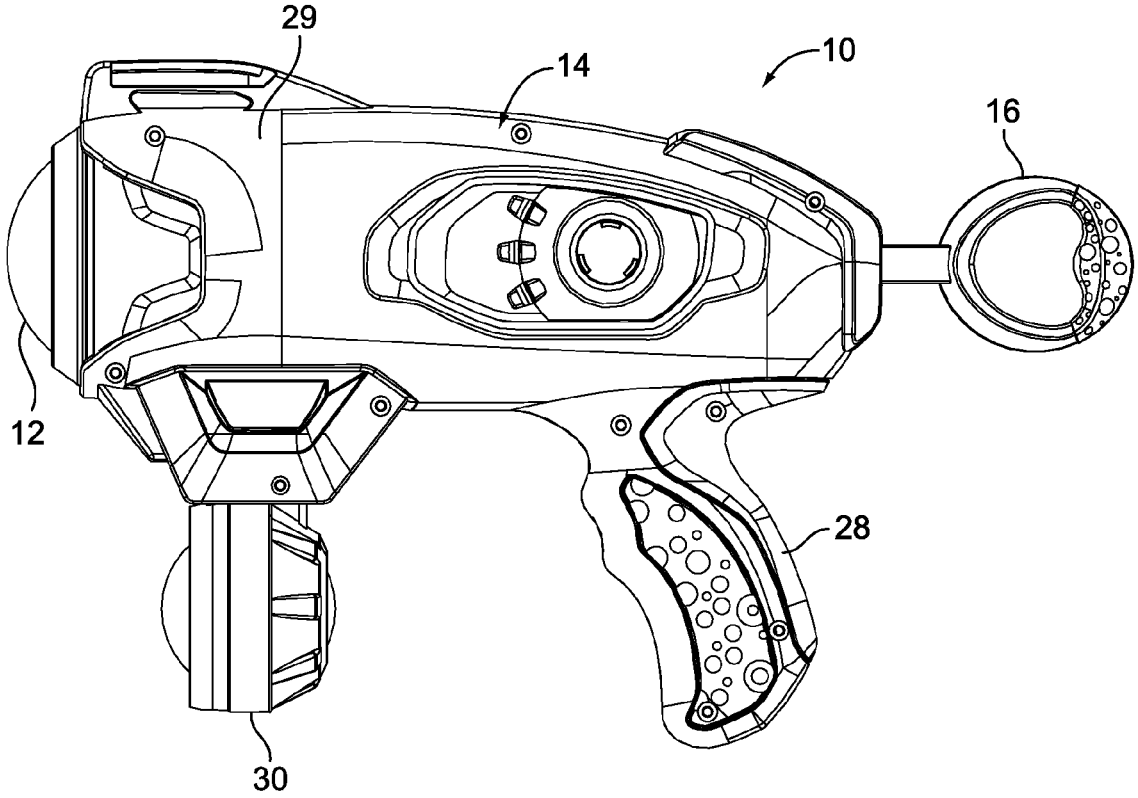
FIG. 1 is a side elevation view of a preferred embodiment of the present invention in the form of a toy projectile launcher apparatus loaded with a ball to be discharged.
Figure 3:
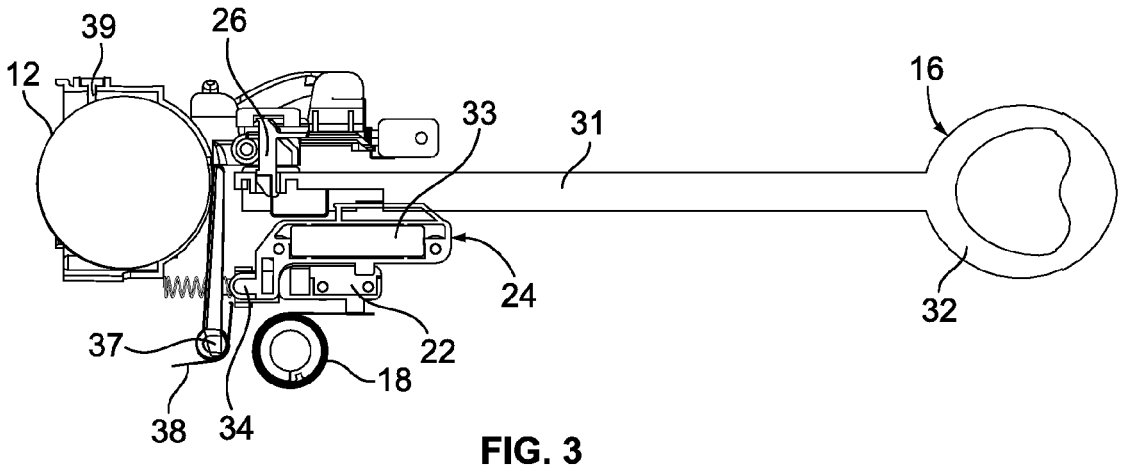
FIG. 3 is a diagrammatic side elevation view of internal elements for firing the toy projectile launcher apparatus shown in FIG. 1.
Figure 2:
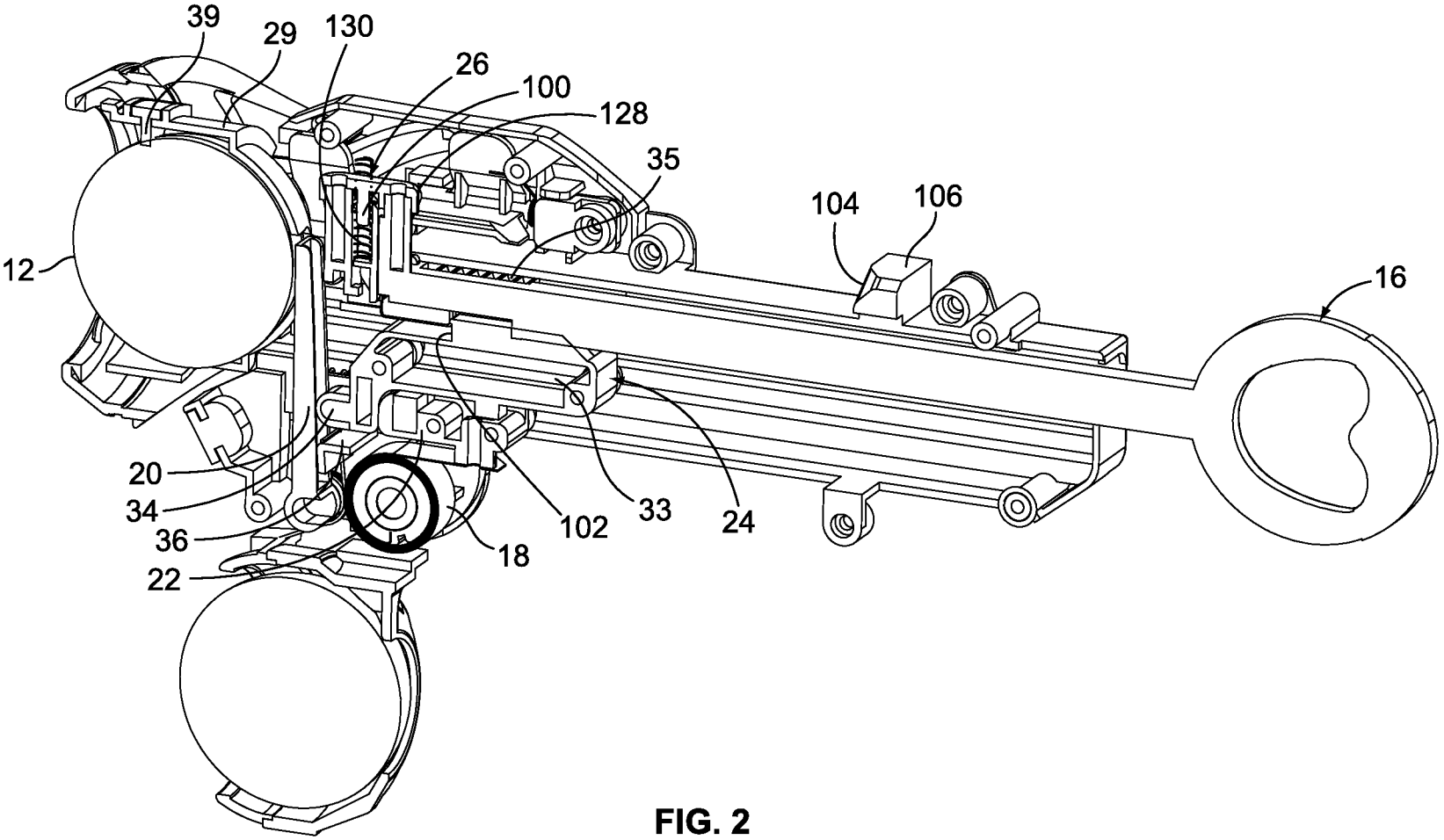
FIG. 2 is an enlarged isometric sectional view of the toy projectile launcher apparatus shown in FIG. 1.
Figure 4:
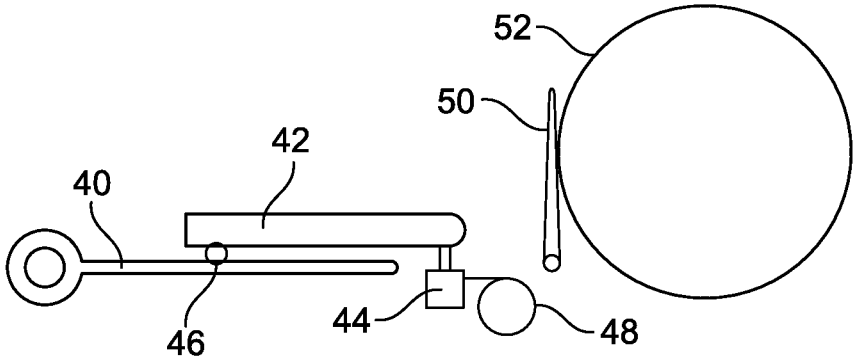
FIG. 4 is a diagrammatic side view of firing elements at rest for the toy projection launcher apparatus shown in FIG. 1-3, including a handle, a ram, a carriage, a connector, a constant force spring and a lever behind a ball to be discharged.

Referring now to FIGS. 1-3, there is shown an embodiment of the invention in the form of a toy projectile launcher apparatus 10 for discharging a spherical-shaped projectile such as a ball 12. The launcher apparatus is designed for safety reasons to prevent its use with most projectiles other than a specific ball. For example, a preferred ball is formed of ethylene vinyl acetate (EVA) having a diameter of about 45.5 to 46.5 mm and a weight of about 4.0 to 4.8 g. The toy launcher apparatus 10 includes a housing or base 14 with an internal frame, a handle 16 mounted to the housing and movable between forward and rearward positions, a launch spring 18 mounted to the housing, a lever or flap 20 pivotally connected to the housing for imparting discharge energy to the ball, a carriage 22 connected to the launch spring 18, a ram 24 and a connector 26. The ram 24 is engagable by the handle 16 and mounted to abut the carriage 22 when the ram is moved rearward by the handle, and when the ram is moved forward it is connected to the carriage to allow the ram to slide further forward relative to the carriage when the carriage stops. The extra forward motion allows the ram to impact the lever and cause the lever to pivot and hit the ball. The connector 26 releasably holds the ram. The handle, the spring, the ram, the carriage, the connector and the lever may be considered "firing elements."

Figure 5:
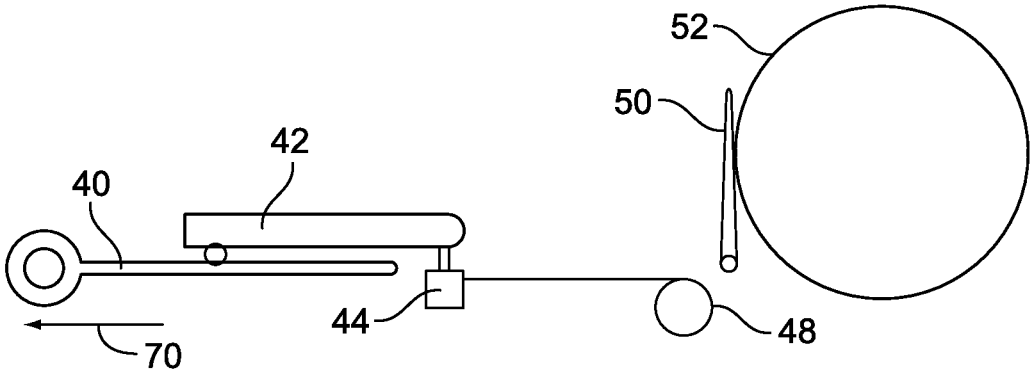
FIG. 5 is a diagrammatic side view illustrating the handle, the ram, the carriage and the connector moved rearward as a unit and the constant force spring being extended.

The housing 14 includes a grip 28 and a barrel 29, the grip enabling a user to hold and aim the launcher apparatus while easily loading and cocking the apparatus by inserting a ball in the barrel and by pulling the handle rearward, as illustrated in FIG. 5. A ball storage holder 30 may be provided beneath the barrel. The pistol configuration shown is highly stylized and may include designs of popular merchandising concepts such as "StarWars." In the alternative, the launcher apparatus may be shaped to look more like a real gun or a cannon, or some other toy figure. In another variation the apparatus may be formed as a real weapon.

Figure 6:
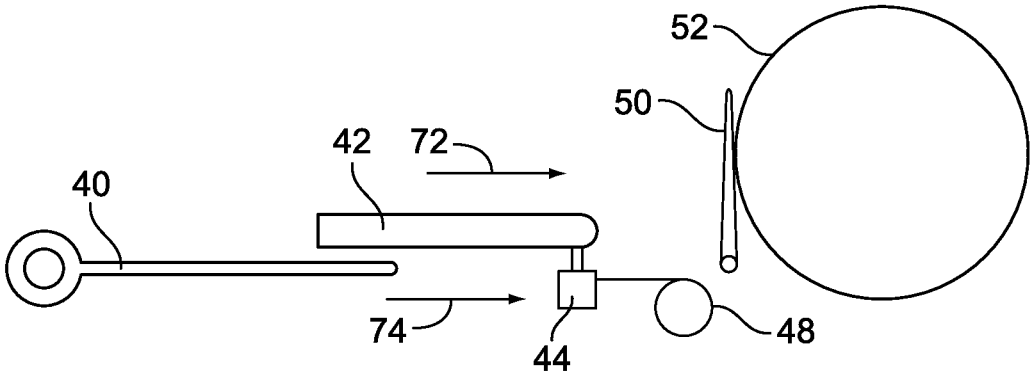
FIG. 6 is a diagrammatic side view of the ram and the carriage disconnected from the handle and being moved forward toward the lever and the ball by the constant force spring.

The handle 16 includes a rod portion 31 and a pull portion 32. The handle is operated by a user who grasps the pull portion 32 to move the handle from a forward position shown in FIG. 1, to a rearward position shown in FIGS. 5 and 6. Extending the handle also extends the launch spring 18 to provide energy to discharge the ball. In a one preferred embodiment the handle is extended rearward about four to four and a half inches to cock the apparatus. The carriage 22 is directly attached to the launch spring 18. The ram 24 is movable between rearward and forward positions and is connected to the handle by a connector 26. The ram has a body portion 33 that glides along the housing frame and a depending nose portion 34 that is located in front or forward of the carriage 22. When the ram is moved rearward by the handle the nose portion abuts the carriage and pushes it rearward. However, when the carriage and the ram are released and snapped forward by the rewinding of the launch spring that is connected to the carriage, the carriage abuts the nose portion of the ram and drives the ram forward. When the carriage comes to a halt before any contact with the lever, the body portion of the ram slides forward relative to the carriage to enable the nose portion to impact the lever.

After the handle 16 has been retracted or moved rearward to a predetermined location, the connector 26 disconnects or disengages the ram 24 from the handle 16 and the carriage and the ram snap forward under the influence of a biasing force from the launch spring 18. The handle may remain extended if held by the hand of a user and may be returned by a return spring 35 once the handle is released. In the preferred embodiment, the launch spring 18 requires about five pounds of pull force to cause extension. A bumper 36 (best seen in FIGS. 13 and 16) may be included to limit or stop the forward motion of the carriage 22 while the ram 24 is able to continue forward even though no longer connected to the launch spring due to momentum, by sliding relative to the carriage for another inch to inch and a half so as to impact the lever 20 as will be explained and illustrated in more detail below. The ram is relatively heavy and the lever relatively light so that there is a relatively large energy transfer when the ram impacts or strikes the lever and the lever hits or slaps the ball.

In the alternative, the handle may extend laterally like a rifle bolt to be gripped by a user to cock the launcher apparatus by manually moving the bolt handle to the rearward position and then manually returning the bolt handle to the forward position, and the connector may be part of a trigger assembly. When the bolt handle is extended to a predetermined distance or to a predetermined location, cocking the apparatus, the connector may engage the ram or the carriage and restrain them until a trigger is pulled, firing the apparatus.

The launch spring 18 is preferably a constant force spring, also known as a negator spring, and requires approximately a constant five pounds of pull for the spring to be extended rearward. When the spring is released there is approximately a constant five pounds of biasing force acting on the ram and the carriage during the entire forward movement. The handle may be connected to the return spring. In the alternative, a coil spring may be used as the launch spring instead of the negator spring, but operation is not as efficient or efficacious. Also, the predetermined distance may be more or less than four to four and a half inches and the spring force more or less than five pounds.

The lever 20 is rotatably mounted to move between an upstanding position shown in FIG. 2, and an impacted position shown sequentially in FIGS. 8-10, and FIG. 13, where a lever is struck by a ram and causes the lever to slap or smack a ball. Upon impact by the ram the lever rotates forward (to the right in FIGS. 8-10) to transfer energy from the ram to the ball to cause discharge of the ball. After first contact with the ball, the lever continues to rotate in contact with the ball to induced backspin. It has been found that backspin generates an aerodynamic lifting force, thereby enabling the ball to travel a greater distance with the same amount of input energy. The lever is mounted to a shaft 37, FIG. 3, to which is also mounted a return torsion spring 38 that returns the lever to the upright starting position. To help increase backspin on the ball, a backspin protrusion or wiper 39 may be attached to the barrel and positioned to cause the ball to be slightly squeezed as discharge occurs. A friction force is generated in a rearward direction thereby causing the ball to increase its rearward rotation or backspin.

Referring now to FIGS. 4-10, the operation of the firing elements of the toy launcher apparatus 10, and other variations described in detail below, is illustrated in simplified diagrammatic form. The firing elements shown in FIG. 4 include a handle 40, a ram 42, a carriage 44, a connector 46, a negator spring 48, and a lever 50. The lever is located just behind a ball 52 to be discharged. The connector insures that the ram 42 moves with the handle 40 when a user pulls on the handle in a rearward direction. However, at the predetermined rearward location, the ram 42 detaches or disengages from the handle 40 and the carriage with the ram snap forward under the influence of the launch spring 48. When the carriage 44 reaches its starting position it stops but the ram 42 is able to continue forward by sliding relative to the carriage. The ram continues forward and impacts the lever 50 and thereby transfers energy from the relatively heavy and fast moving ram to the ball. In an alternative, the ram may be latched in the rearward position, the handle may return forward, and a trigger mechanism may be used to release the ram.

Figure 7:
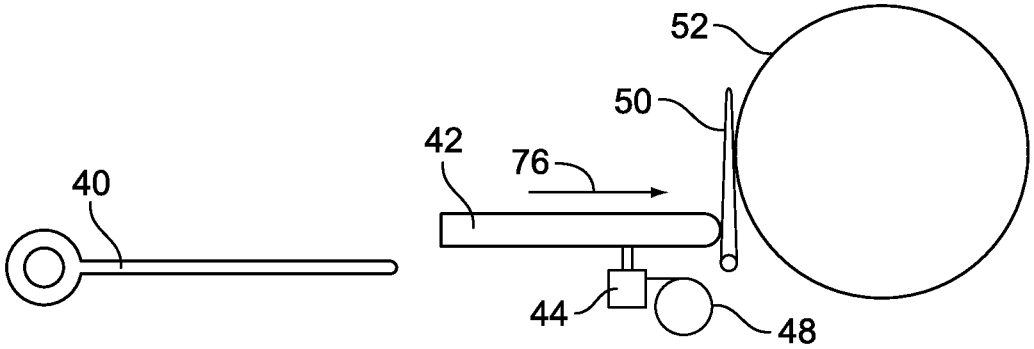
FIG. 7 is a diagrammatic side view of the ram sliding relative to the stopped carriage to impact the lever.

Referring again to FIG. 4, the firing elements are at rest with the ball 52 loaded in the barrel. Next, a user pulls the handle 40 rearward as represented by an arrow 70, FIG. 5. Along with the handle 40, the connected or engaged ram 42 and the abutted carriage 44 are also moved rearward, and the launch spring 48 is loaded by being extended rearward. After a predetermined extension of the launch spring, the handle, the ram and the carriage reach a predetermined location. At the predetermined location, an element causes the connector 46 to release the ram 42 from the handle 40, allowing the carriage, which is attached to the spring 48, to be rapidly accelerated forward. The carriage drives the ram forward. After separation the ram 42 and the carriage 44 move forward together as represented by the arrows 72, 74, FIG. 6, under the influence of the launch spring 48 toward the lever 50. The handle remains in the rearward position if the user continues to hold the handle. The carriage 44 only moves forward to its start position, as shown in FIG. 7, which may include impact with a bumper. The ram 42, however, which is slidable relative to the carriage, is able to continue forward motion as also depicted in FIG. 7, and as represented by the arrow 76. By sliding forward on its own, the relatively heavy and fast moving ram 42 is able to transfer considerable energy to the lever.

Figure 8:
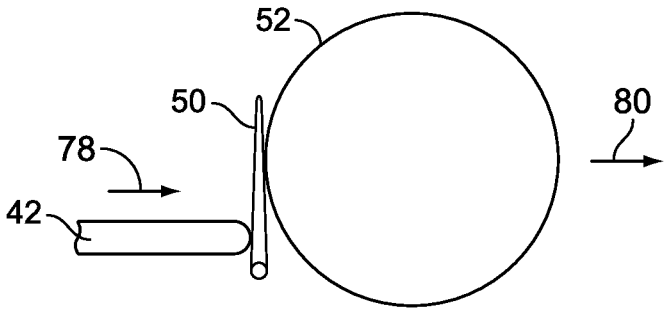
FIG. 8 is a diagrammatic side view of the ram impacting the lever and the lever slapping the ball.
Figure 9:
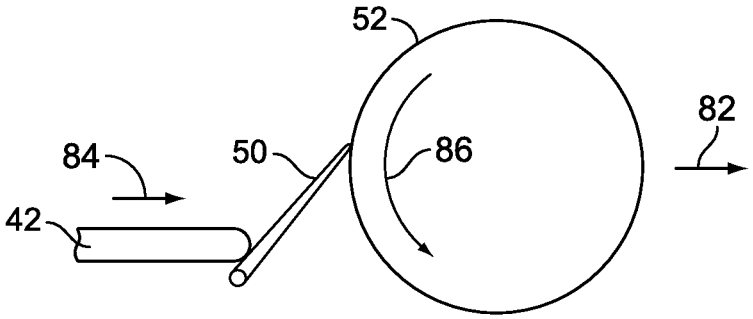
FIG. 9 is diagrammatic side view of the ram continuing to impact the lever, and the lever continuing to impact the ball to induce a backspin in the ball.
Figure 10:
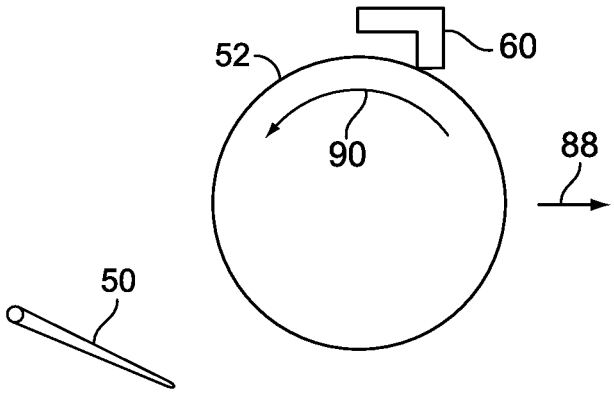
FIG. 10 is diagrammatic side view of the lever no longer in contact with the ball and the ball moving passed a backspin inducing protrusion.

The moving ram impacts or strikes the lever 50 at a location about two-thirds down from the top of the lever as again depicted in FIG. 7. An arrow 78, FIG. 8, represents movement of the ram as it impacts the lever. The impact engenders a force multiplier effect as the lever 50 slaps or smacks the ball 52, accelerating the ball to the right in the drawing, represented by the arrow 80. Energy transfer from the ram to the lever and then to the ball starts on impact of the ram with the lever and continues as the lever rotates clockwise as shown in FIG. 9. The ball continues to move to the right as represented by an arrow 82. It is noted that the ram 42 continues to transfer energy to the ball, as depicted by an arrow 84. The downward rotating motion of the lever also imparts a counterclockwise backspin in the ball as indicated by an arrow 86, in addition to a discharge force. After the ball separates from the lever and moves in the direction of an arrow 88, FIG. 10, the ball may pass and lightly contact a wiper 60 to enhance the counterclockwise backspin in the ball depicted by an arrow 90, because a frictional force component is engendered on the ball.

The launch lever continues to rotate clockwise until a lever return spring stops and reverses the direction of the lever. The lever is lightweight in comparison to the ram, and the return spring offers light resistance to the ram since only a small spring rate in needed to return the lever to its upstanding position. After ball discharges, the user may release the handle to allow the handle return spring to bring the handle forward to the position shown in FIG. 4, where the handle 40 may reengage the ram 42.

It is noted that throughout this disclosure, words such as "forward", "rearward", "upper", "lower", "front", and "rear", as well as like terms, refer to portions of the launcher apparatus as they are viewed in the drawings relative to other portions or in relationship to positions of the apparatus as it will typically be held and moved during play when operated by a user.

Figure 11:
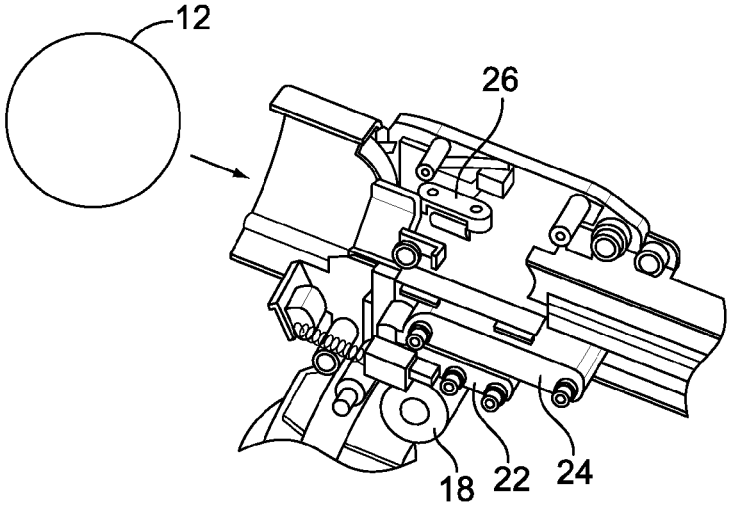
FIG. 11 is a partial isometric sectional view of the launcher apparatus being loaded with a ball.
Figure 12:
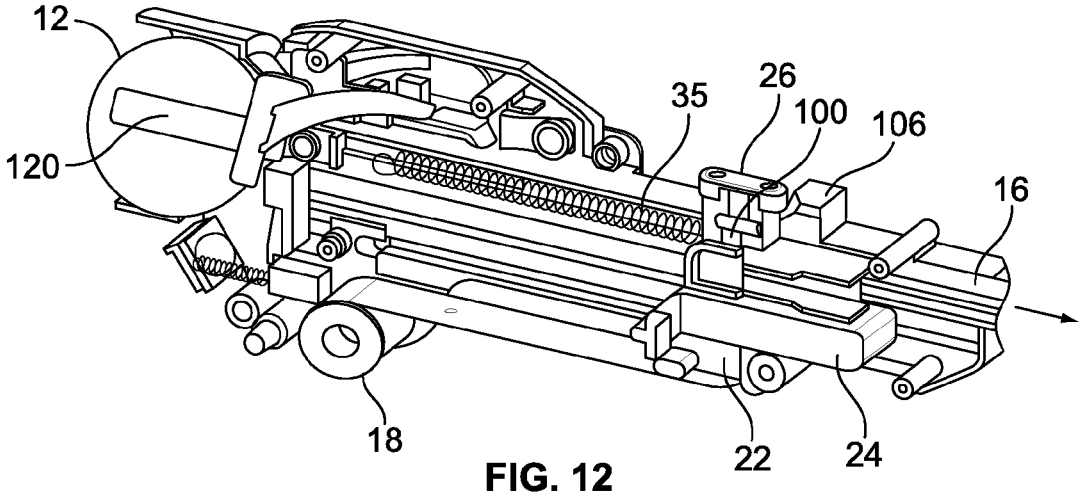
FIG. 12 is a partial isometric sectional view of the launcher apparatus illustrating the handle moving the ram and carriage rearward to a firing position.
Figure 13:
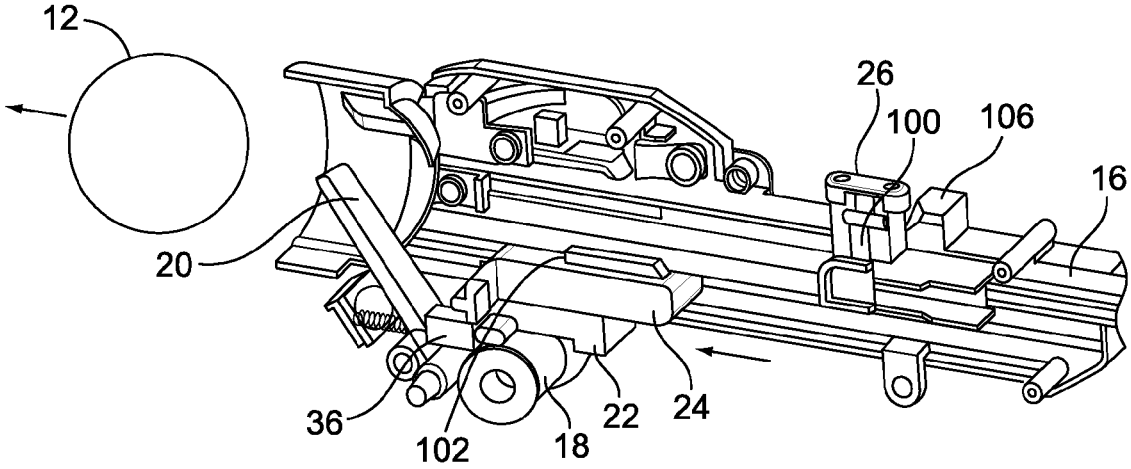
FIG. 13 is a partial isometric sectional view of the launcher apparatus illustrating the handle and connector at the firing position, the ram and the carriage in forward positions and the ball being discharged.
Figure 14:
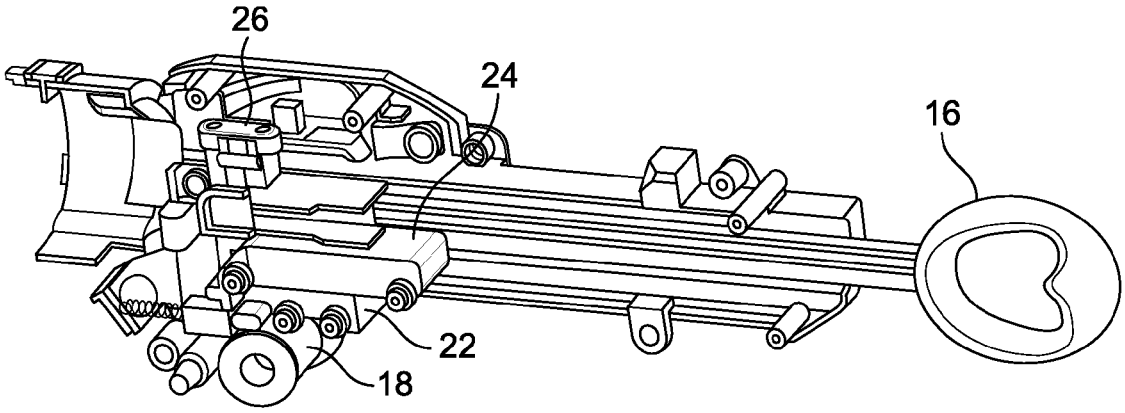
FIG. 14 is a partial isometric sectional view of the launcher apparatus illustrating the handle, the connector, the ram and the carriage after discharge of the ball.

In operation of the launcher apparatus 10, FIGS. 1-3 and 11-14, the proper ball 12, in size and perhaps weight, is inserted in a barrel 29 as shown in FIG. 11. Placing the ball in the barrel causes the connector 26, which includes a vertically slidable arm or pin 100, FIG. 2, to move between an upper position, shown in FIG. 2, and a lower position shown in FIG. 12. In the lower position the pin is located forward of the ram 24. When the handle 16 is moved rearward the pin connector 100 engages an abutment surface 102 of the ram 24 and pushes the ram rearward, as shown in FIG. 12. In turn, the ram moves the carriage 22 and extends the attached negator spring 18, also shown in FIG. 12. When the handle is moved rearward to a predetermined location, a ramp 104 on a protrusion 106, FIGS. 2, 12, and 13, cams the connector pin 100 upward so that the ram 24 as well as the carriage 22 are released from the handle 16, and the ram and carriage are able to move rapidly forward because of the biasing force of the negator spring as shown in FIG. 13. This operation may be considered automatic because firing or discharging of the launcher apparatus 10 shown in FIGS. 1-3 and 11-14, does not require any action of the user other than retraction of the handle 16. The carriage 22 stops at the bumper 36, however, the ram 24 continues to slide forward on its own to impact the lever 20, FIG. 13, causing the lever to slap the ball 12 resulting in discharge. The handle 16, FIG. 14, may then be released by the user to have it return forward under the influence of the return spring 35, FIG. 12, to the start position shown in FIGS. 2 and 14, where the handle is repositioned with the connector pin 100, the ram 24 and the carriage 22.

In the alternative, the ram and the carriage may be deleted and the handle may be made heavier and attached directly to the launch spring to operate like a slingshot. Other projectile shapes may be used instead of the ball, however, safety considerations are a concern. Size and weight may change as may the travel distance of the handle to more or less than about four to four and a half inches. Also the launch spring may have a pull force of more or less than about five pounds. The launcher apparatus may include, in the alternative, a projectile magazine, such as a cartridge, a cassette, a canister or a tube loaded with multiple projectiles.

Figure 15:
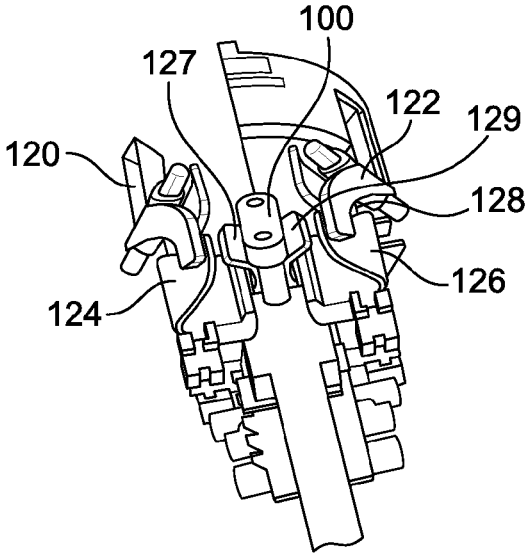
FIG. 15 is a partial isometric sectional view of the launcher apparatus illustrating arms and flanges for operating the connector.
Figure 16:
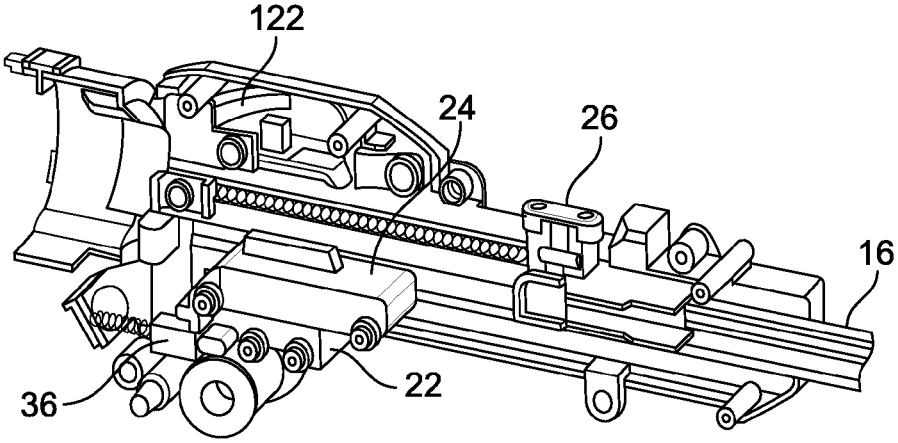
FIG. 16 is a partial isometric sectional view of the launcher apparatus illustrating firing elements when no ball is loaded where the ram and the carriage remain stationary when the handle is refracted.
Figure 17:
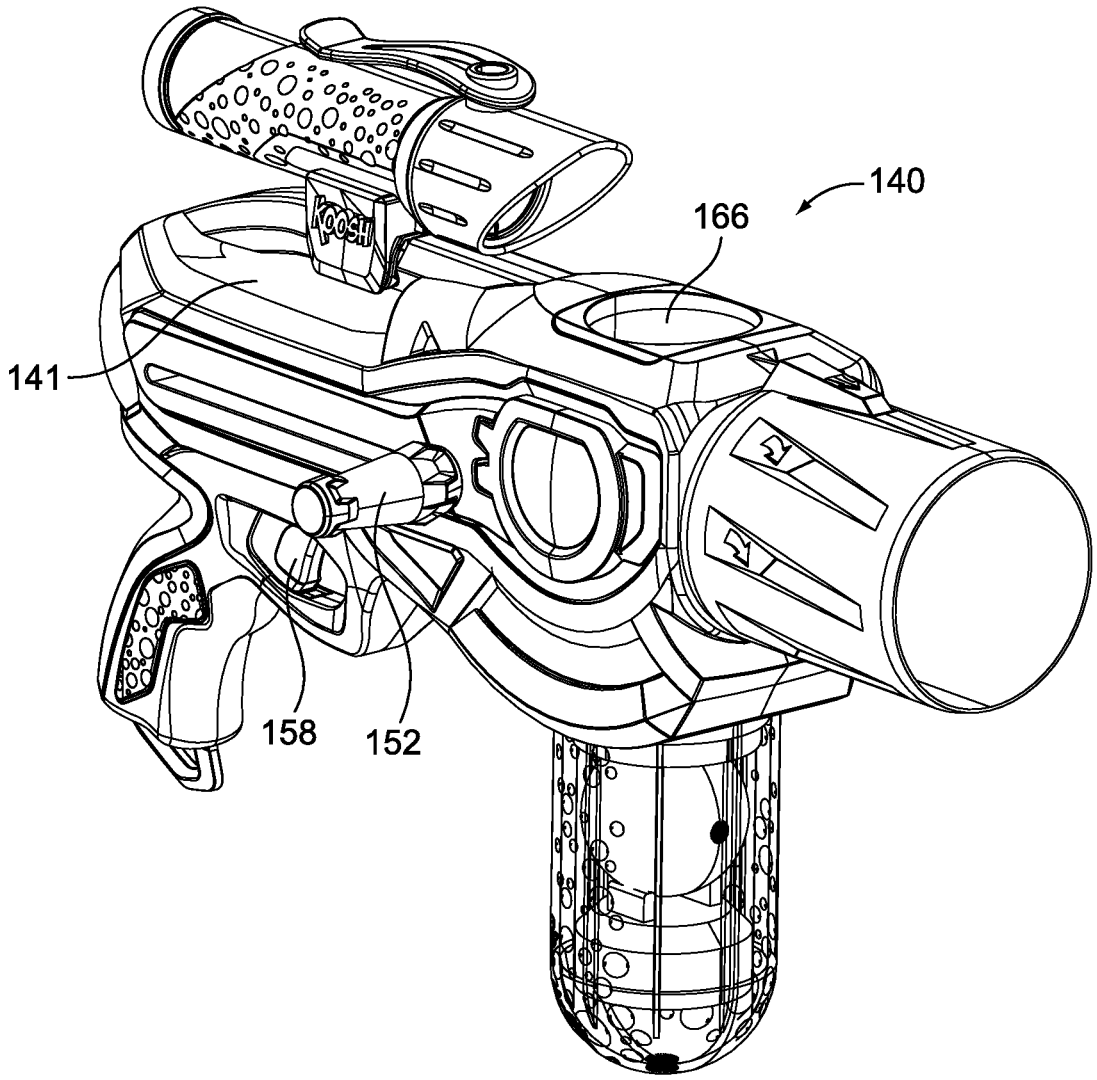
FIG. 17 is an isometric view of another embodiment of a launcher apparatus with an attached ball magazine beneath the apparatus, a side bolt handle and a trigger assembly.

Another important feature of the present invention, sometimes referred to as "simulation play," enables the apparatus 10 to be used without a ball or other approved projectile and yet users are able to role-play. The same mechanism that allows simulation play also provides a safety feature in that an attempt to load most items other than the ball mentioned above will alter the manner in which the launcher apparatus operates. Referring now to FIGS. 12, 15 and 16, the apparatus 10 includes a pair of pivotal ball contacting arms 120, 122, FIG. 15, that are mounted in the barrel 29 of the launcher apparatus. The ball arms 120, 122 are engagable with a mating pair of arrester arms 124, 126 that in turn engage flanges 127, 129 that operate the connector pin 100. The arrester arms 124, 126 are biased by springs, such as the spring 128, to hold the connector pin in the upper position where the connector pin remains out of engagement with the ram. When a ball is inserted into the barrel of the launcher apparatus, the ball forces rotation of the ball arms 120, 122 that in turn rotate the arrester arms 124, 126 away from engagement with the flanges 127, 129 so that the connector pin is no longer supported. The connector pin 100, biased by a spring 130, FIG. 2, is then able to drop to the lower position and abut the ram. Hence, when the handle is refracted the ram as well as the carriage move with the handle. However, if no ball is inserted into the barrel, or if an item that is smaller or differently shaped than the ball is inserted, the ball arms 120, 122 do not rotate and they do not disengage the arrester arms 124, 126 from the flanges of the connector pin. The result is that the connector pin does engage the ram with the handle and when the handle is retracted, and the ram and carriage do not move, as shown in FIG. 16. The handle may then be release in the usual way and the return spring 35 returns the handle to its start position. The feature of the launcher apparatus is that it may be operated in a similar manner whether or not a ball is loaded.

Referring now to FIGS. 17-20, another variation of the inventive launcher apparatus is shown in the form of a magazine fed toy gun 140. The toy gun 140 includes a housing 141, a ram 142, a carriage 144, a negator spring 146, a lever 148 and a ram latch bar lock 150. The toy gun also includes a sliding bolt handle 152, FIG. 17, located at the side of the toy gun instead of at the rear where the previously described handle was located for the embodiment shown in FIGS. 1-3 and 11-16. The toy gun additionally includes a half way lock 154 to enable loading of several balls into a magazine 156, a trigger assembly 158, a ball detector 160, a front gate 162 and a backspin pin 164. To operate the toy gun 140, a user pulls the bolt handle 152 rearward causing a link 163 to engage a ram surface 165. Rearward movement of the bolt handle results in both the ram and the carriage moving rearward because the nose portion of the ram engages the carriage when moving rearward as mentioned earlier. After the bolt handle has moved about half way, it is locked by the lock 154 from forward movement, allowing the user to load the magazine 156 with balls through an opening 166 in the top of the toy gun.

Figure 18:
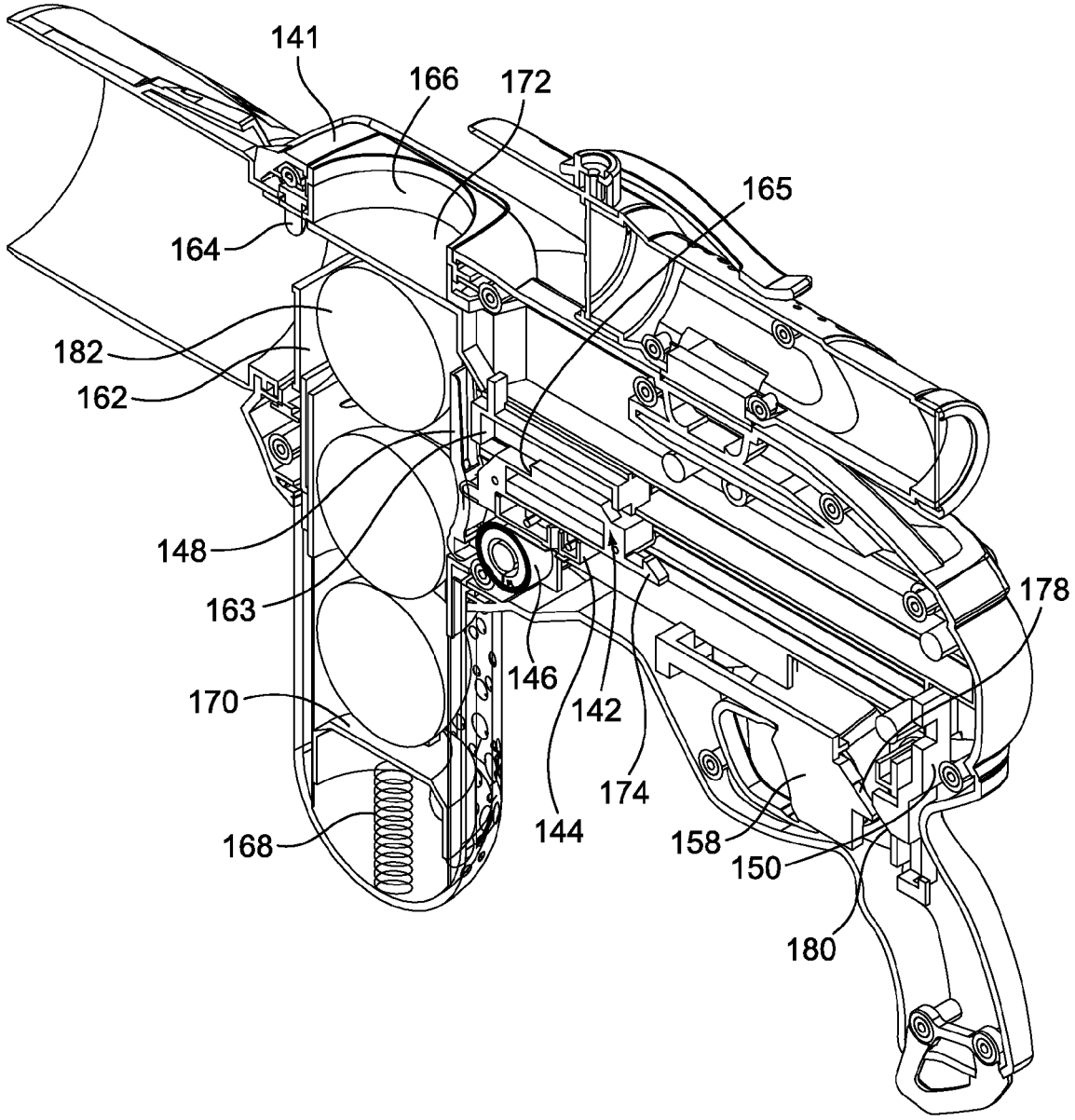
FIG. 18 is an enlarged isometric sectional view of the launcher apparatus shown in FIG. 17.
Figure 19:
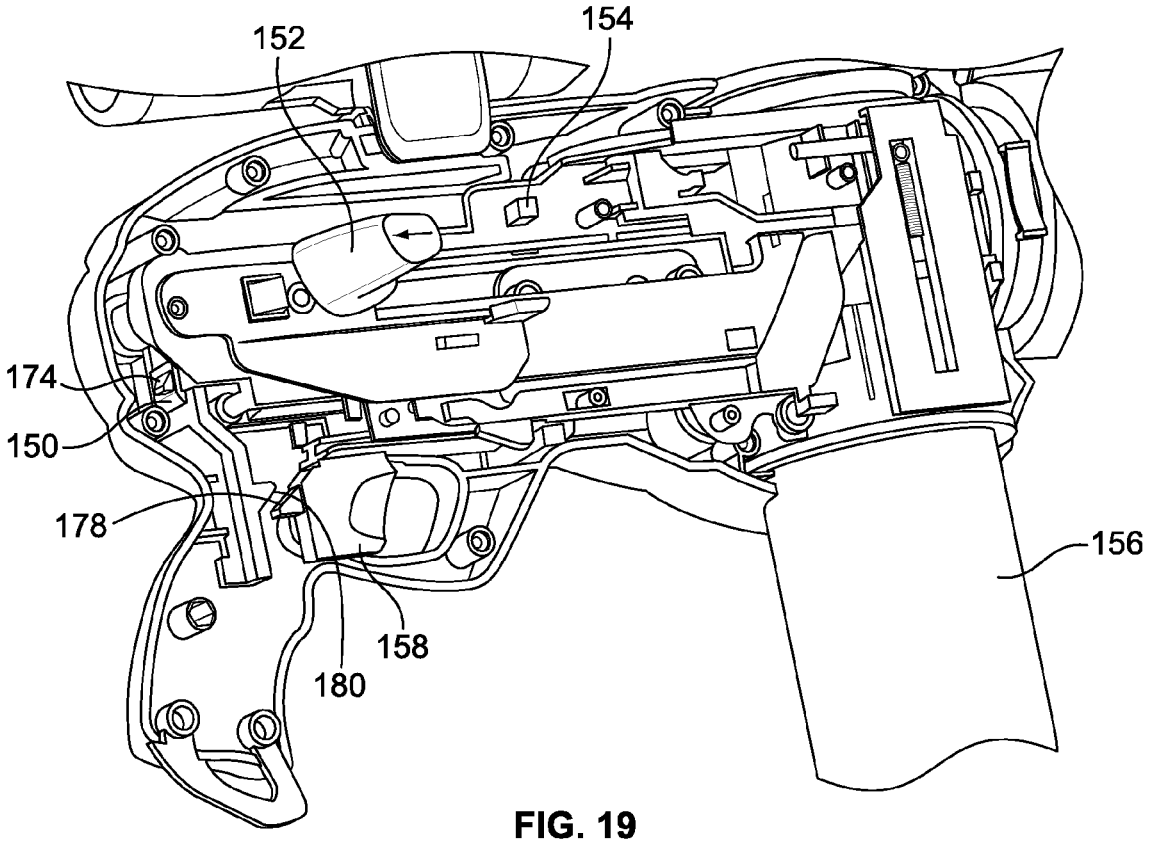
FIG. 19 is another isometric sectional view of the toy projectile launcher apparatus shown in FIG. 17, and illustrating a connector latching a ram in a rearward position.
Figure 20:
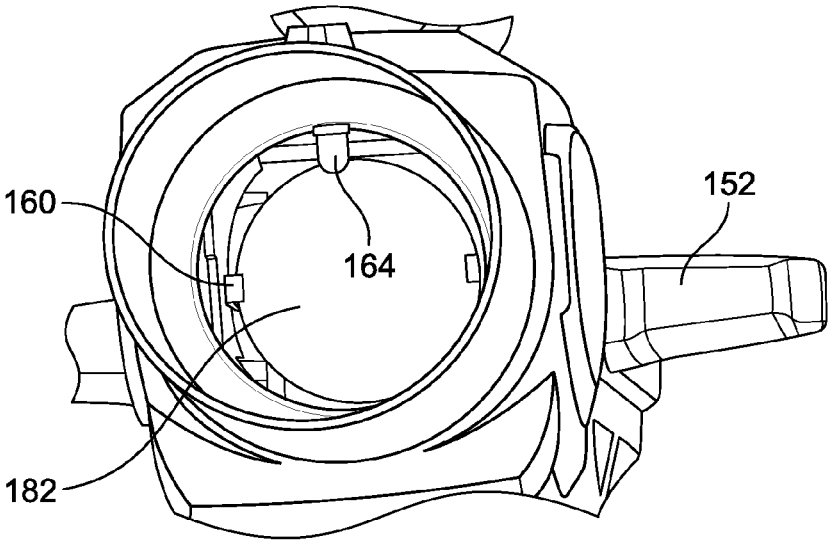
FIG. 20 is a front isometric view of the toy projectile launcher apparatus shown in FIG. 17, illustrating a backspin wiper.

The magazine 156 is a tube having a spring 168 and a spring cover 170 which bias the balls in the tube upward to a discharge position as shown in FIG. 18. A panel 172 at the top of the tube prevents the loaded balls from exiting the tube. Thereafter, the bolt handle may be moved fully rearward by the user and then fully forward. A series of locks, latches and safety mechanisms are activated and deactivated by the bolt handle movement. Unlike the earlier embodiment, the gun does not automatically fire when the cocking handle reaches a predetermined position. Instead, when the bolt handle is moved fully rearward, a predetermined location, a latch 174, which is part of the ram 142, is engaged by the spring-biased latch bar 150. A user must pull back the trigger assembly 158 causing a ramp 178 of the trigger assembly to push a ramp 180 of the latch bar lock upward. When the lock is lifted, the latch 174 is released, the carriage snaps forward under the influence of the biasing force of the negator spring 146, and the carriage takes the ram along. The ram strikes the lever 148, and the lever slaps an upper ball 182 causing discharge. The user must re-cock the gun to load the next ball and set up the ram and carriage again.

Figure 21:
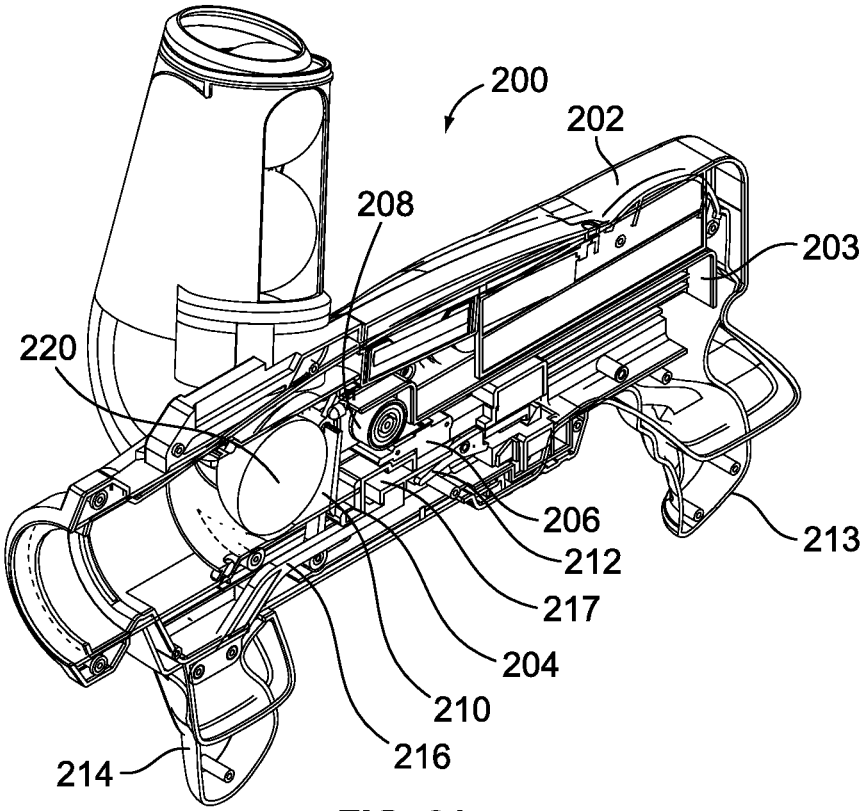
FIG. 21 is an isometric sectional view of still another embodiment of a launcher apparatus with a gravity fed ball magazine, and a sliding grip handle.
Figure 22:
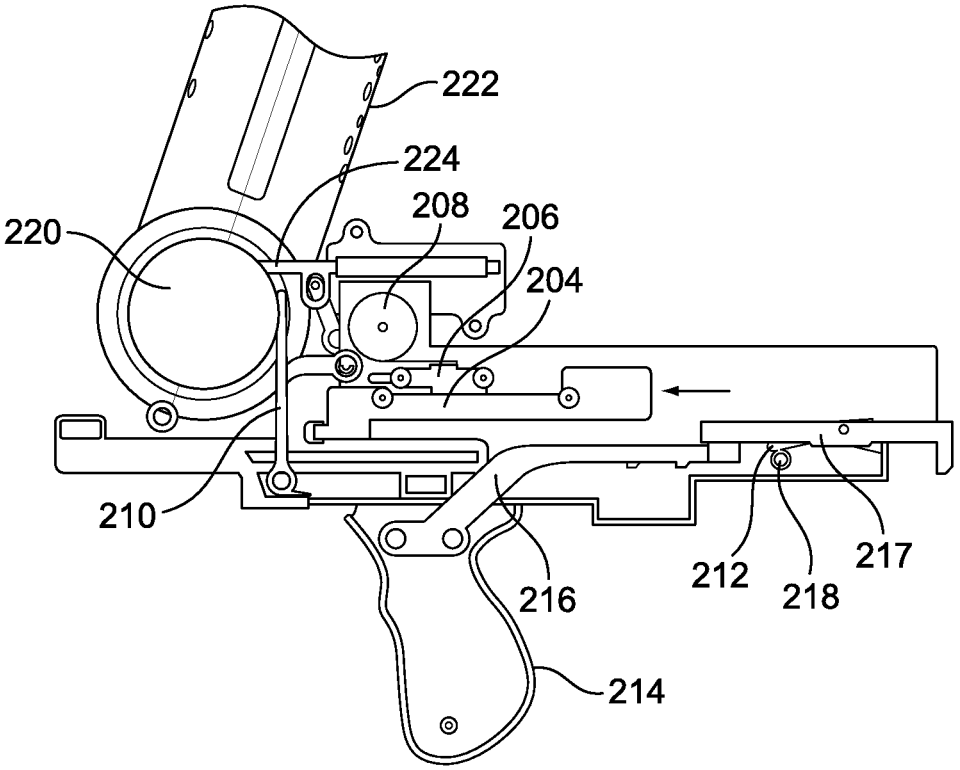
FIG. 22 is diagrammatic side view of the launcher apparatus shown in FIG. 21, illustrating an automatic release of a connector resulting in a ram and a carriage quickly moving forward under the biasing force of a negator spring toward a lever, and a pin blocking balls in the magazine.

Another variation is illustrated in FIGS. 21-22, in the form of a gravity fed toy gun 200. The gun includes the usual housing 202 with a frame 203, a ram 204, a carriage 206, a negator spring 208, a lever 210, a ram lock 212 and a control grip 213. Instead of a rear or side located handle as described previously, the toy gun 200 includes a grip handle 214 located beneath the housing 202 for cocking the gun. Like the first described embodiment shown in FIGS. 1-3 and 11-16, discharge is automatic once the handle is moved rearward to a predetermined location. When the grip handle 214 and links 216, 217 are moved rearward to a predetermined location, depicted by a circular protrusion 218, the ram lock 212 releases the ram 204 as depicted in FIG. 22, and the ram 204 along with the carriage snap forward to impact the lever 210 and discharge a ball 220. The toy gun 200 also includes a gravity feed magazine 222 and a blocking pin 224 that extends into the magazine when the grip handle 214 starts its rearward movement. After the ball is discharged and the grip handle returned to its full forward position by the user, the blocking pin 224 retracts to allow the next ball in the magazine to move to a discharge position in front of the lever. Additional features such as sound may be included to all of the embodiments to enhance play value. It is noted that the negator spring 208 is located above the carriage and the carriage is located above the ram unlike the embodiments mentioned above where the spring was beneath the carriage and the carriage was beneath the ram. Operation is the same with either arrangement.

Figure 23:
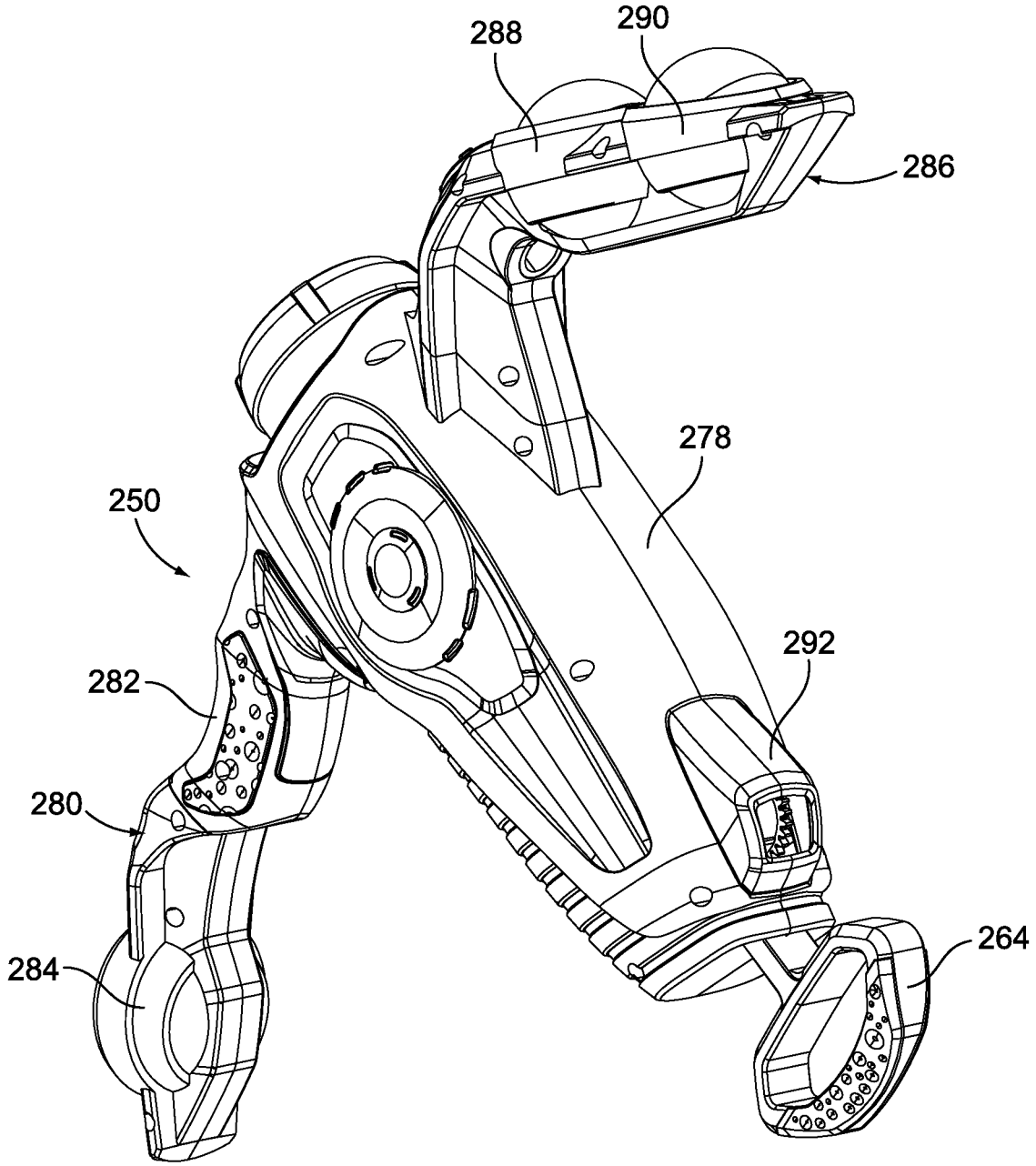
FIG. 23 is an isometric sectional view of yet another embodiment of a launcher apparatus in form of a bow shaped gun, a rear located handle and three ball storage locations.
Figure 24:
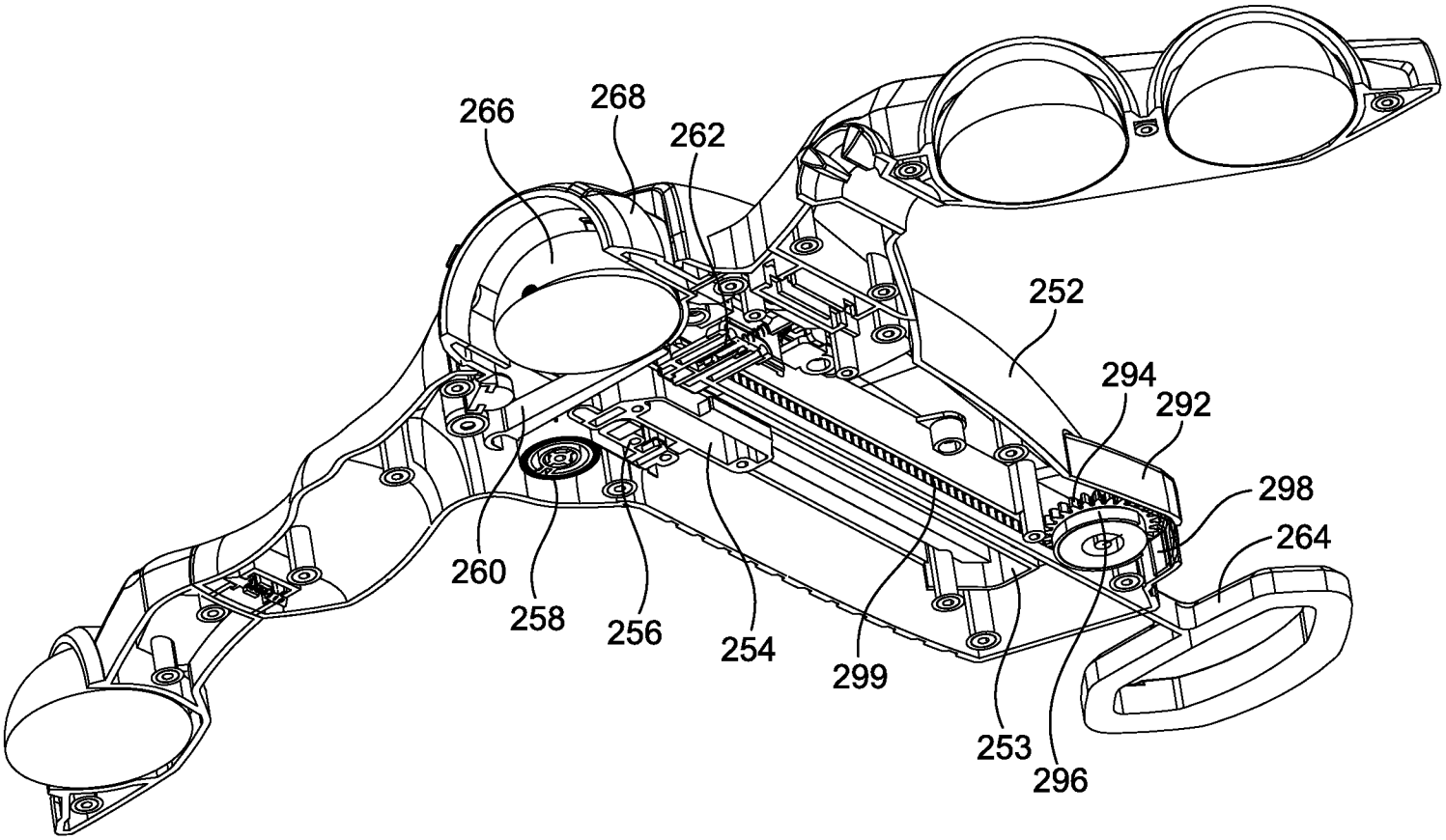
FIG. 24 is an isometric sectional view of the launcher apparatus shown in FIG. 23.
Figure 25:
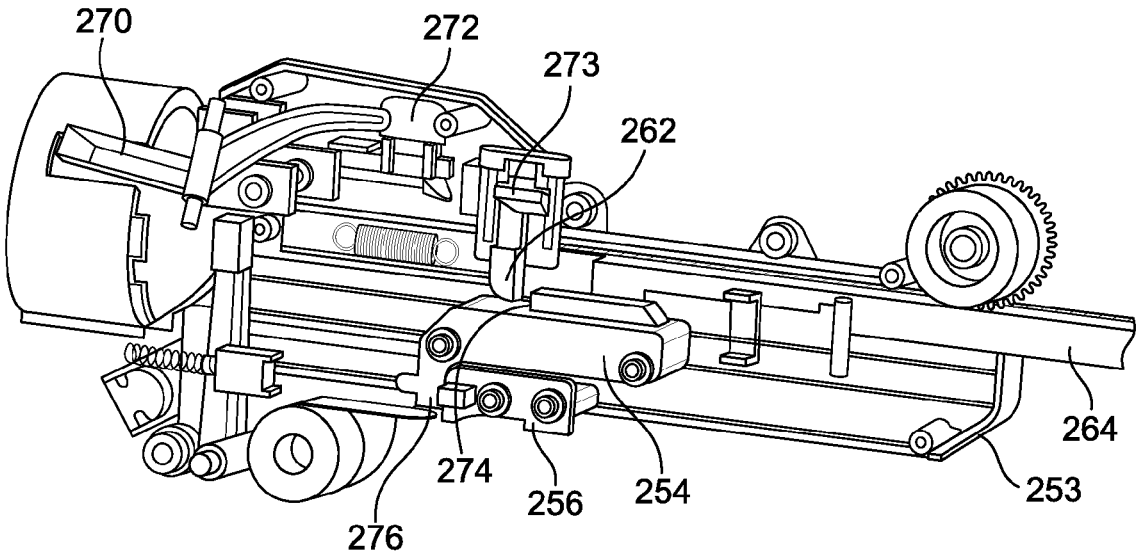
FIG. 25 is an isometric sectional view of the launcher apparatus shown in FIGS. 23 and 24, illustrating a handle and a connector engaging and moving a ram and a carriage rearward after a ball is loaded.
Figure 26:
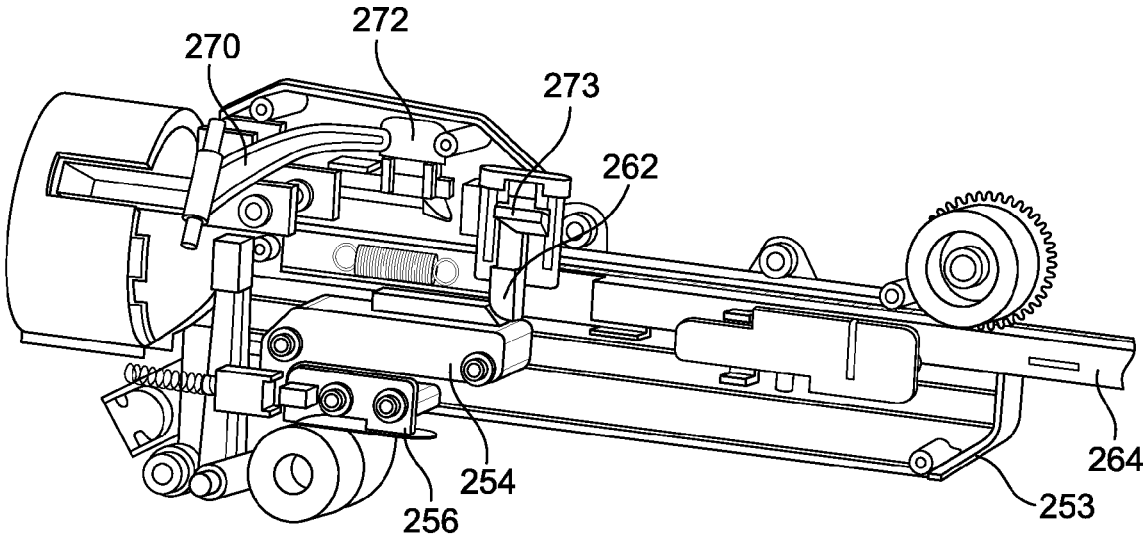
FIG. 26 is an isometric sectional view of the launcher apparatus shown in FIGS. 23-25, illustrating the handle and the connector moving rearward without the ram and the carriage because no ball has been loaded.

Continuing to illustrate the breath of the present invention, yet another variation is illustrated in FIGS. 23-26, in the form of a bow shaped toy gun 250. The bow gun 250 also includes a housing 252 with a frame 253, a ram 254, a carriage 256, a negator spring 258, a lever 260, a ram lock 262 and a handle 264. The firing elements are very similar to those in the embodiment described in detail and illustrated in FIGS. 1-3, and 11-16, where the toy gun 10 may be used with or without a loaded ball. The bow gun 250 automatically releases the ram 254 when the handle 264 reaches a predetermined location, such as after the handle is fully refracted and then returned partway forward. However, if no ball is loaded or the wrong projectile is used in the bow gun, the handle 264 may still be retracted in the usual manner, but the ram and carriage do not engage the ram lock and do not move rearward, resulting in no discharge. If a ball 266, FIG. 24, is loaded in the barrel 268, a linkage of two pairs of arms and two flanges, such as the arm 270, FIG. 25, the arm 272, and the flange 273, allow the ram lock 262 to descend and engage an abutment surface 274 on the ram 254 such that the ram and the carriage are moved rearward, the nose portion 276 of the ram abutting the carriage 256, when the handle 264 is pulled rearward. If no ball is loaded or an item that is an incorrect size is loaded, the linkage arms do not release the ram lock until the handle is retracted beyond the ram, as shown in FIG. 26, so that the ram does not engage the ram lock and the ram 254 and the carriage 256 do not move.

The bow gun 250 includes a fuselage portion 278, FIG. 23, and two wings or arms, a lower arm 280 having a grip portion 282 and a ball storage slot 284, and an upper arm 286 having two ball storage slots 288, 290. The bow gun may include another feature called a power meter 292. The meter 292 may include a geared inner roller 294, FIG. 24, an outer roller 296 and a display 298. The handle 264 may also be geared 299 and may engage the inner roller 294. As the handle is refracted the inner roller rotates until the handle is retracted a predetermined distance, such as seventy five to eighty millimeters. At that distance the outer roller 296 begins to rotate to indicate the distance of retraction to the user. The handle displacement may be translated to power or discharge force, namely, the force available from the negator spring to cause ball discharge. The further rearward the handle is moved, up to about one hundred and fifteen millimeters, the greater will be the force of discharge and the further the discharged ball will travel. To inform the user, the meter display 298 may indicate three degrees of power: "zero," "half" and "max."

Figure 27:
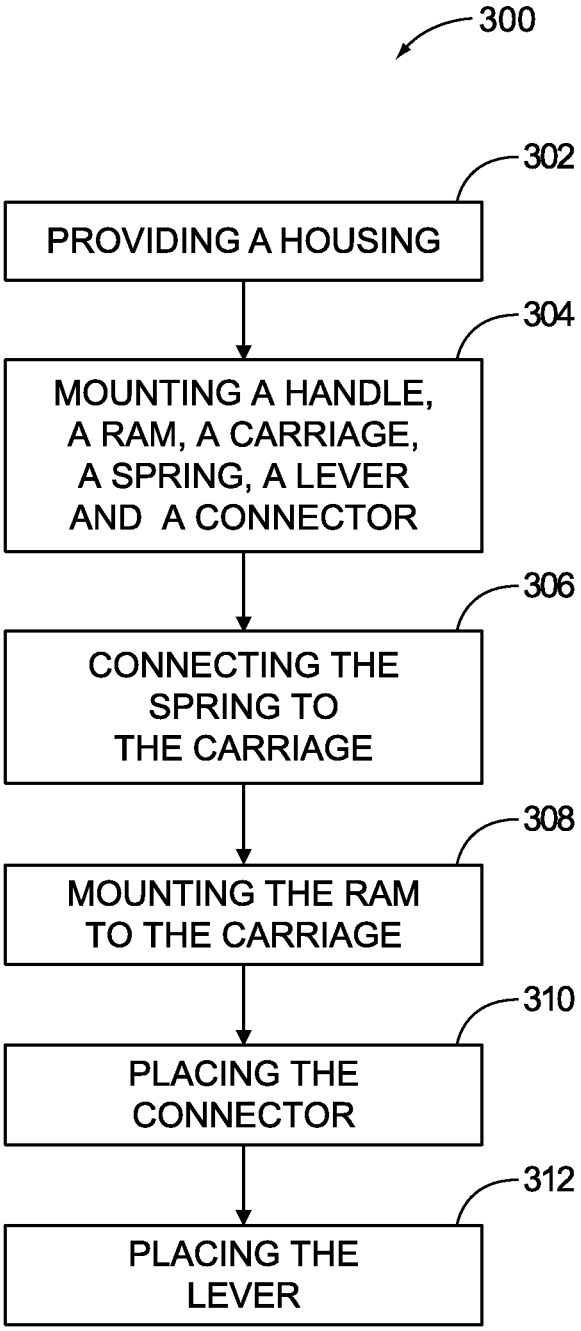
FIG. 27 is a flow diagram for a method of making the toy projectile launcher apparatus of the present invention.
Figure 28:
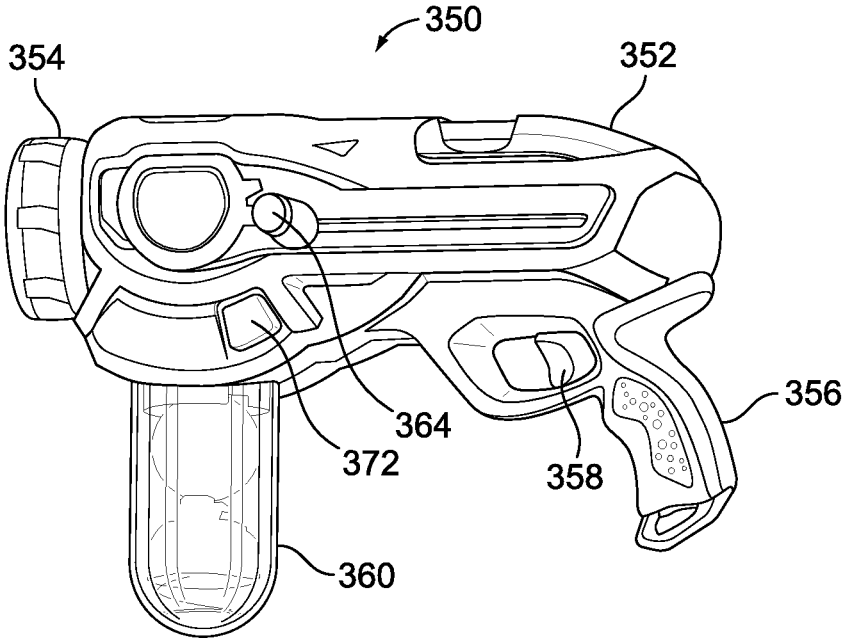
FIG. 28 is a side elevation view of another embodiment, one having a movable lever on a shaft and oppositely disposed knobs that a user may depress to move the lever laterally to the longitudinal axis of the launcher apparatus.
Figure 29:
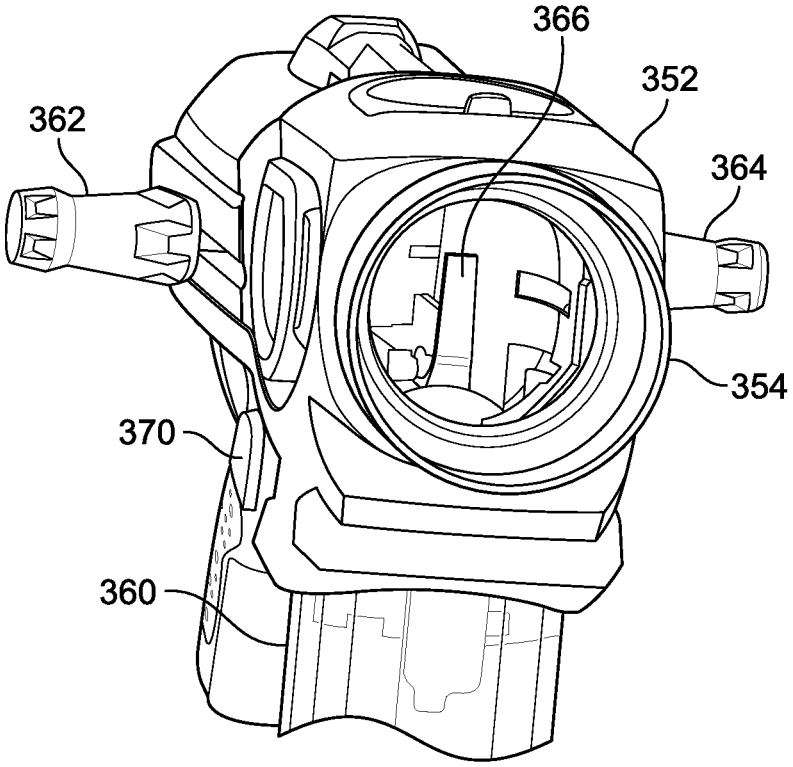
FIG. 29 is a front isometric view of the launcher apparatus embodiment shown in FIG. 28.

The present invention also includes a method for making a toy projectile launcher apparatus 300, FIG. 27, capable of discharging a lightweight ball, the steps including providing a housing 302, mounting a handle, a ram, a carriage, a spring, a lever and a connector to the housing 304, connecting the spring to the carriage 306, slidably mounting the ram to the carriage 308, placing the connector 310 to engage the ram when the spring is extended and to disengage the ram to enable the ram and the carriage to quickly moving under the influence of the spring, and placing the lever so as to be impacted by the moving ram 312, the impacted lever being able to rotate and slap the ball resulting in the ball's discharge.

Figure 30:
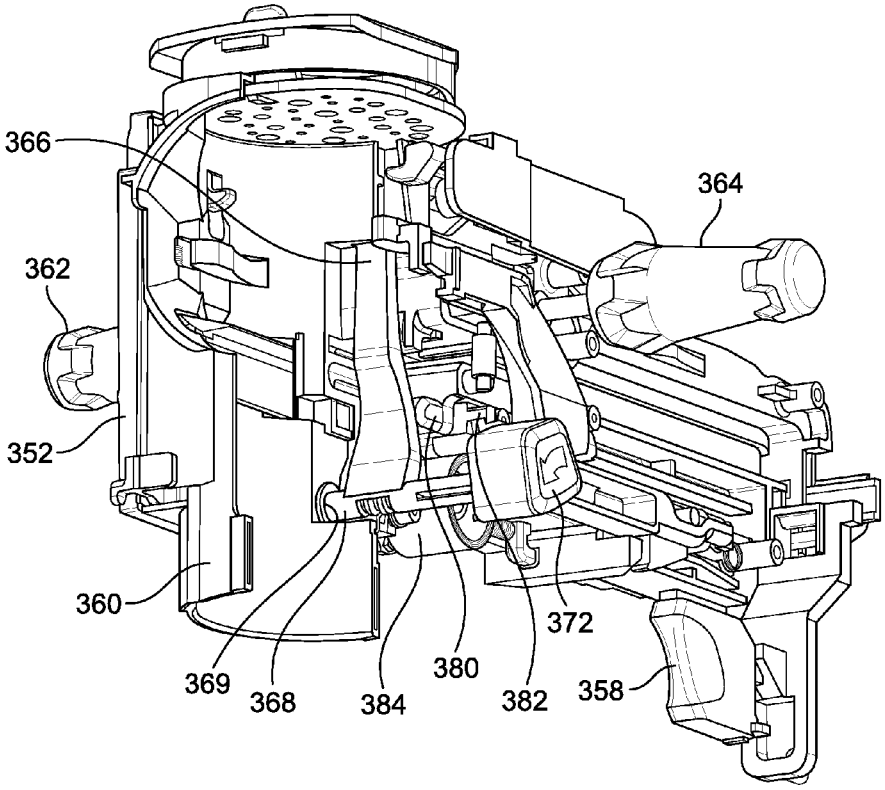
FIG. 30 is a front isometric view of the launcher apparatus shown in FIGS. 28 and 29, with part of the launcher's housing removed.
Figure 31:
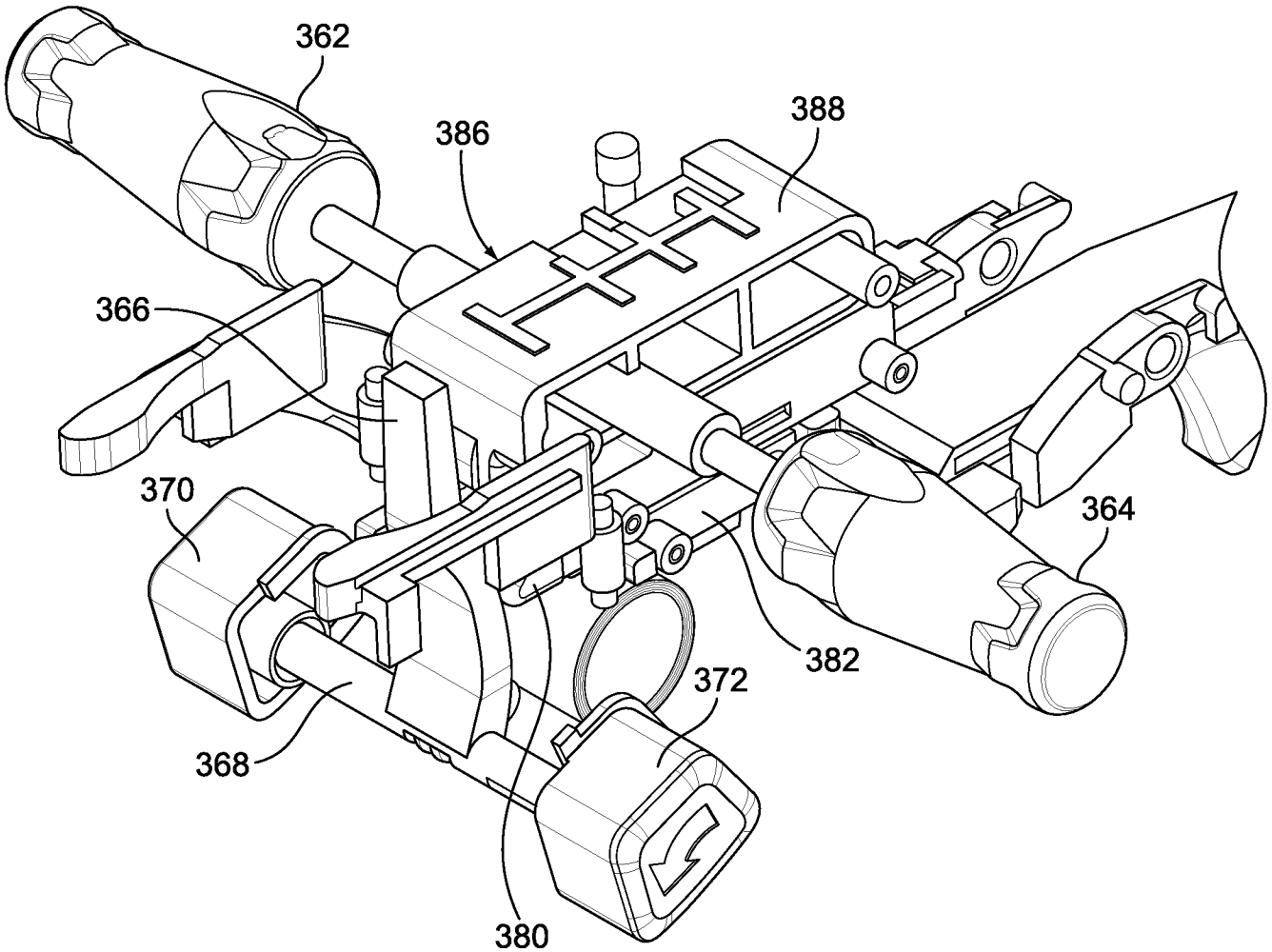
FIG. 31 is a front isometric view of the launcher apparatus shown in FIGS. 28-30, with the housing removed.

Referring now to FIGS. 28-31, another embodiment of the inventive launcher apparatus is disclosed in the present continuation-in-part application/patent in the form of a magazine fed toy projectile launcher apparatus 350 that is very similar to the launcher apparatus 140 described above and illustrated in FIGS. 17-20. The launcher apparatus 350 includes a housing 352, a forward located barrel portion 354, a rearward located grip portion 356, a trigger 358, a foam ball magazine 360, and sliding bolt handles 362, 364 connected to the housing and moveable between forward and rearward positions generally parallel to a longitudinal axis of the housing extending from the barrel portion to the grip portion, the bolt handles being used for cocking the launcher apparatus 350. Pivotally connected to the housing 352 in the barrel portion 354 is a lever 366 for "slapping" a soft foam ball to cause the ball's discharge. The lever 366 is mounted to a rotatable shaft 368, and the shaft includes end portions supported by the housing or an internal frame connected to the housing, such as by sleeves or bushings integral with the housing or frame. One such bushing 369 is illustrated in FIG. 30. Another bushing, not shown, supports the other end portion of the shaft. Mounted at each end of the shaft 368 are operating knobs 370, 372, one knob to each side of the housing 352. By pushing or depressing one knob or the other, the shaft with the attached lever is movable to one side or the other in a direction parallel to the longitudinal axis of the shaft and generally perpendicular to the longitudinal axis of the housing.

Inside the housing 352 of the launcher apparatus 350, the main operating mechanism is the same as that disclosed in the launcher 140 and illustrated in FIGS. 17-20, including a ram 380 mounted on a carriage 382, a constant force negator spring 384 connected to the carriage, and a cocking module 386 including the handles 362, 364 and a link 388. The handles are used for moving the ram and the carriage rearward toward the grip portion 356 to cause the negator spring 384 to extend and store energy. When released, the negator spring snaps the carriage and ram forward toward the barrel portion 354 where the ram impacts the lever 366 and transfers the energy from the spring 384 to a loaded ball. The combination of the lever 366, the shaft 368 and the knobs 370, 372 gives the launcher apparatus 350 an additional feature beyond that disclosed in relation to the launcher 140 that enhances play value because the lever may be moved between predetermined left, right and center positions for defining the path to be taken by a discharging ball. In doing so, the ball may be made to curve left or right or discharge straight ahead by selectively inducing a sidespin to the left, a sidespin to the right, or a backspin.

Figure 32:
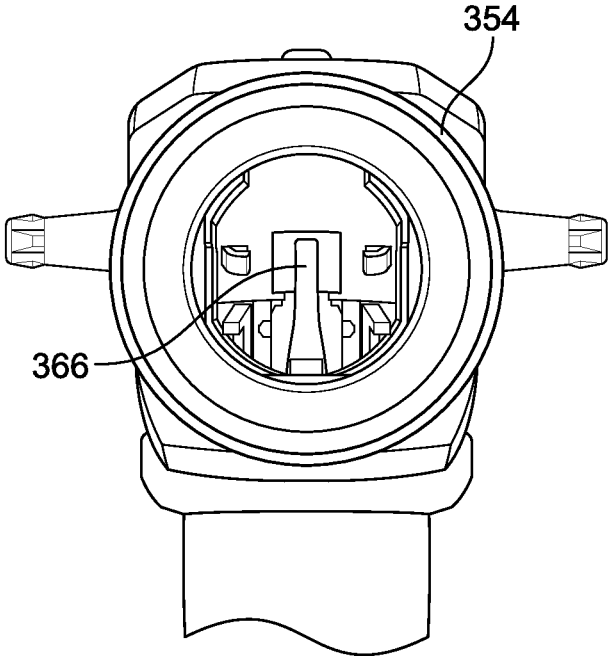
FIG. 32 is a front elevation of the launcher apparatus shown in FIGS. 28-31 with the lever in a center position.
Figure 33:
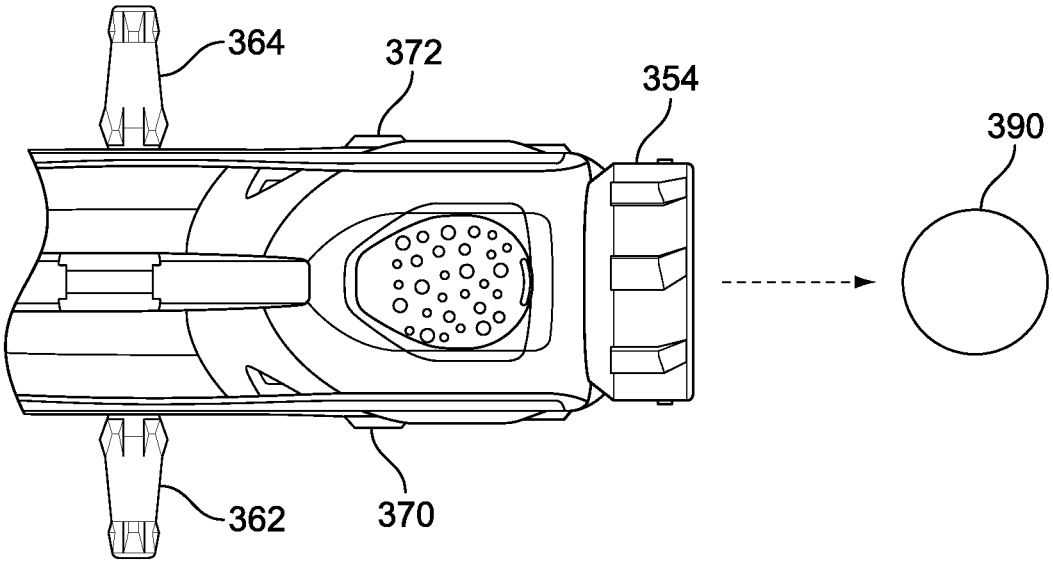
FIG. 33 is a top plan view of a portion of the launcher apparatus shown in FIGS. 28-32 with a discharging ball moving generally in a straight line.
Figure 34:
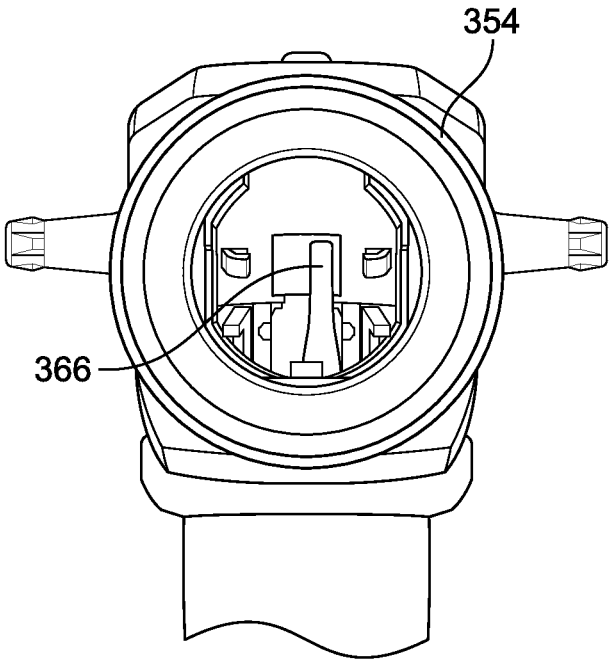
FIG. 34 is a front elevation of the launcher apparatus shown in FIGS. 28-33 with the lever in a rightward position.
Figure 35:
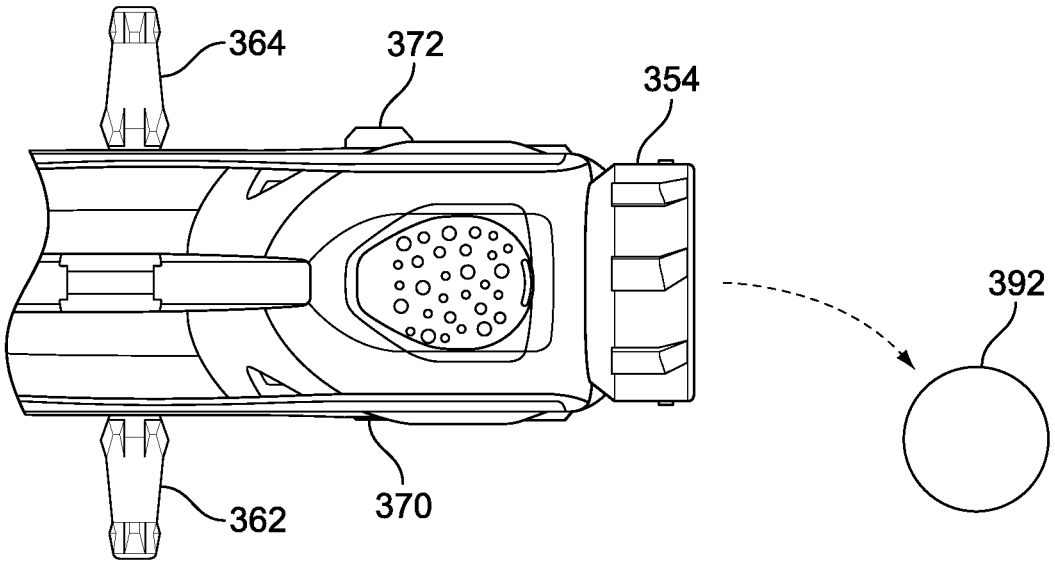
FIG. 35 is a top plan view of a portion of the launcher apparatus shown in FIGS. 28-34 with a discharging ball curving to the right.
Figure 36:
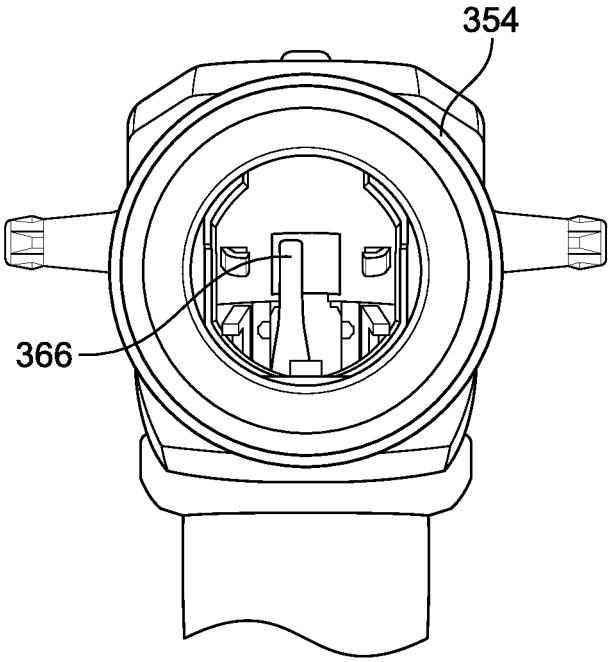
FIG. 36 is a front elevation of the launcher apparatus shown in FIGS. 28-35 with the lever in a leftward position.
Figure 37:
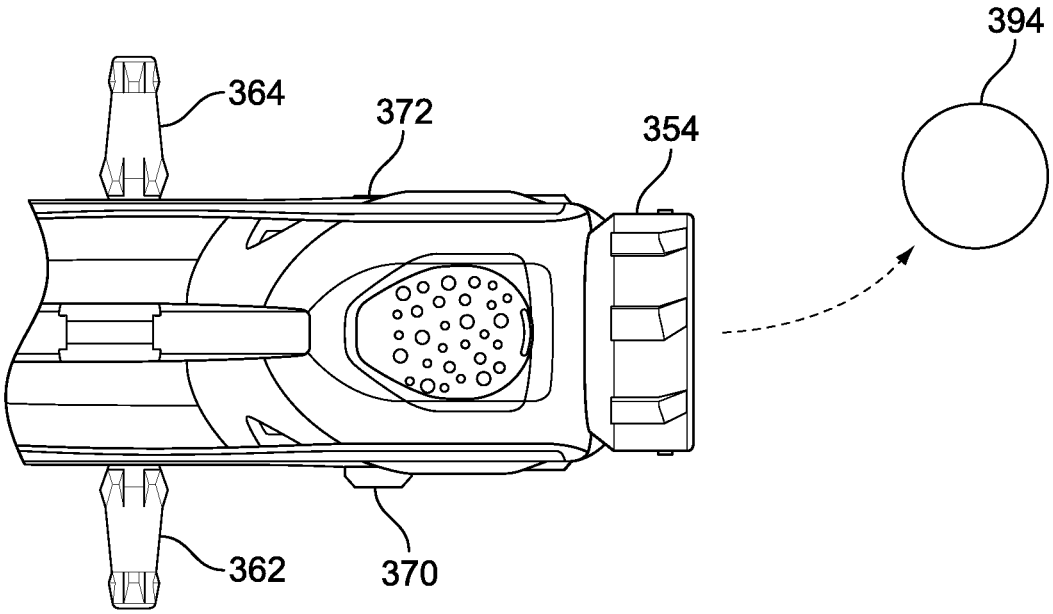
FIG. 37 is a top plan view of a portion of the launcher apparatus shown in FIGS. 28-36 with a discharging ball curving to the left.

The lever-shaft-knobs combination enables a user of the launcher 350 to vary the path of discharging foam balls in a predetermined manner. The lever 366 is movable laterally as illustrated in FIGS. 32, 34 and 36, a middle position illustrated in FIG. 32, a far right position (when viewed from the front of the launcher) illustrated in FIG. 34, and a far left position illustrated in FIG. 36. When the lever 366 is in the middle position, a ball 390 will be discharged in generally a straight line as illustrated in FIG. 33. When the knob 370 is depressed, moving the shaft 368 and the lever 366 to the right, a discharging ball 392 will curve to the right (when the ball is viewed from the position of a user behind the launcher) as illustrated in FIG. 35. When the knob 372 is depressed, moving the shaft 368 and the lever 366 to the left, a discharging ball 394 will curve to the left as illustrated in FIG. 37. It is to be noted that the lever 366 may also be moved to a predetermined position other than fully left or fully right. The lever may be moved partway left or partway right to control the curved path of the discharging ball. Having the ability to move the lever to the right or to the left allows the user to hit targets that may be behind obstructions, giving the user great flexibility, an advantage over someone using a toy launcher that does not have the curve-ball feature.

Figure 38:
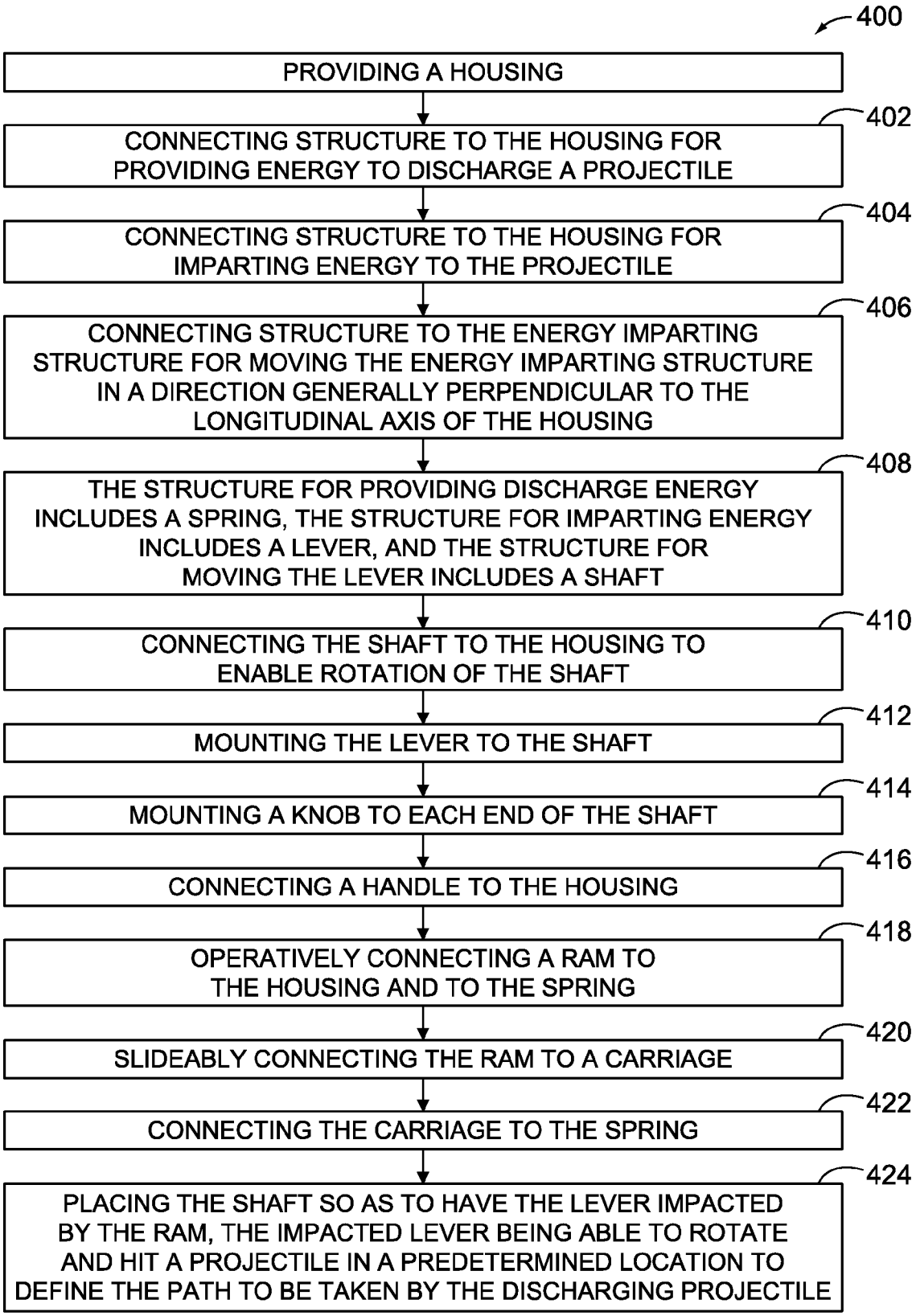
FIG. 38 is a flow diagram of another method for making a toy projectile launcher apparatus of the present invention.

A method 400, FIG. 38, for making a launcher apparatus may include the steps of providing a housing 402 having a longitudinal axis, connecting structure to the housing for providing energy to discharge a projectile 404, such the launch spring, connecting structure to the housing for imparting energy to the projectile 406, such as the lever, and connecting structure, such as the rotatable shaft, to the energy imparting structure for moving the energy imparting structure in a direction generally perpendicular to the longitudinal axis of the housing 408. The method may also include the steps of connecting the shaft to the housing 410 to enable rotation of the shaft, mounting the lever 412 to the shaft, mounting a knob to each end of the shaft 414, connecting a handle to the housing 416 for extending the spring, operatively connecting a ram 418 to the housing and to the spring for impacting the lever, slideably connecting the ram to a carriage 420, connecting the carriage to the spring 422, and placing the shaft 424 so as to have the lever impacted by the ram, the impacted lever being able to rotate and hit a projectile in a predetermined location to define the path to be taken by the discharging projectile.

The toy projectile launcher apparatus disclosed in detail above has great play value, is fun to use and easy to operate in a safe manner, even for younger children, and yet the launcher apparatus has a robust, but simple structure, that may be produced at a reasonable cost.

From the foregoing, it can be seen that there has been provided features for an improved toy launcher apparatus and a disclosure for the method of the making the toy. While particular embodiments of the present invention have been shown and described in detail, it will be obvious to those skilled in the art that changes, modifications and other variations may be made without departing from the invention in its broader aspects. Therefore, the aim is to cover all such changes, modifications and variations as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile launcher apparatus comprising:

a housing having a longitudinal axis;

structure connected to the housing for providing energy to discharge a projectile mounted to the housing;

structure connected to the housing for imparting discharge energy to the projectile, the structure for imparting discharge energy being movable in a direction generally perpendicular to the longitudinal axis of the housing for curving a projectile upon discharge; and shaft connected to the energy imparting structure for moving the energy imparting structure in a direction parallel to a longitudinal axis of the shaft.

2. The launcher apparatus of claim 1, wherein:

the structure for imparting discharge energy includes a lever.

3. The launcher apparatus of claim 2, wherein:

the lever is mounted to the shaft.

4. The launcher apparatus of claim 3, wherein:

the lever is movable in a direction parallel to the longitudinal axis of the shaft.

5. The launcher apparatus of claim 4, including:

operating knobs connected to opposite ends of the shaft.

6. The launcher apparatus of claim 5, wherein:

the structure for providing energy is a negator spring.

7. A projectile launcher apparatus comprising:

a housing;

a handle mounted to the housing and movable between forward and rearward positions for extending a launch spring located in the housing;

a lever connected to the housing by a rotatable shaft for imparting discharge energy to the projectile, the lever being movable laterally;

structure mounted to opposite ends of the shaft for enabling a user of the launcher apparatus to move the lever and the shaft in a direction parallel to a longitudinal axis of the shaft; and a ram in operable engagement with the handle and the launch spring for impacting the lever to cause the lever to pivot and hit the projectile in a predetermined location.

8. The launcher apparatus of claim 7, wherein:

the structure mounted to opposite ends of the shaft includes first and second knobs.

9. The launcher apparatus of claim 7, wherein:

the lever is movable to cause a discharging projectile to curve.

10. The launcher apparatus of claim 7, wherein:

the lever is movable between three positions, a center position, a leftward position and a rightward position for directing a path of a discharging projectile.

11. The launcher apparatus of claim 10, wherein:

the structure mounted to opposite ends of the shaft includes first and second knobs.

12. The launcher apparatus of claim 11, including:

a carriage operatively connected to the launch spring; and wherein:

the ram is slideably connected to the carriage.

13. A method for making a toy launcher apparatus capable of discharging spherical projectiles, the steps of the method comprising:

providing a housing having a longitudinal axis;

connecting a spring to the housing for providing energy to discharge a projectile;

connecting a shaft to a lever in a direction generally perpendicular to the longitudinal axis of the housing;

connecting the spring for moving the lever for imparting energy to the projectile;

connecting the shaft to the housing to enable rotation of the shaft; and mounting the lever to the shaft.

14. The method of claim 13, including the steps of:

mounting a knob to each end of the shaft;

connecting a handle to the housing for extending the spring; and operatively connecting a ram to the housing and to the spring for impacting the lever.

15. The method of claim 14, including the steps of:

slideably connecting the ram to a carriage;

connecting the carriage to the spring; and placing the shaft so as to have the lever impacted by the ram, the impacted lever being able to rotate and hit a projectile in a predetermined location to define the path to be taken by the discharging projectile.

16. A projectile launcher apparatus comprising:

a housing;

a spring connected to the housing for providing energy to discharge a projectile;

a shaft connected to the housing, the shaft having a longitudinal axis and being rotatable around the longitudinal axis, and the shaft being shiftable in a direction parallel to the longitudinal axis; and a projectile hitting structure mounted to the shaft and movable therewith, the projectile hitting structure being operatively connected to the spring for imparting discharge energy from the spring to the projectile when the shaft and the projectile hitting structure rotate around the longitudinal axis of the shaft, and the projectile hitting structure enabling a discharging projectile to curve by the shaft and the projectile hitting structure being shifted laterally relative to a longitudinal axis of the housing.

17. The projectile launcher apparatus of claim 16, wherein:

the projectile hitting structure is movable between three positions, a center position, a leftward position and a rightward position for directing a path of a discharging projectile.

18. The projectile launcher apparatus of claim 16, wherein:

the spring is a constant force spring.

19. The projectile launcher apparatus of claim 16, wherein:

the spring is a negator spring.

20. The projectile launcher apparatus of claim 16, including:

operating knobs connected to opposite ends of the shaft.

* * * * *